US008322643B2

(12) United States Patent
Gervais et al.

(10) Patent No.: US 8,322,643 B2
(45) Date of Patent: Dec. 4, 2012

(54) ROCK CRUSHER ATTACHMENT

(75) Inventors: Joseph Lucien Fernand Gervais, Manitouwadge (CA); Nicholas Scott Dickson, Val Caron (CA)

(73) Assignee: Mining Technologies International Inc., Sudbury, Ontario (CA)

( * ) Notice: Subject to any disclaimer, the term of this patent is extended or adjusted under 35 U.S.C. 154(b) by 52 days.

(21) Appl. No.: 12/805,307

(22) Filed: Jul. 23, 2010

(65) Prior Publication Data

US 2012/0018558 A1 Jan. 26, 2012

(51) Int. Cl.
*B02C 1/02* (2006.01)

(52) U.S. Cl. ..... 241/101.742; 241/148; 241/264

(58) Field of Classification Search ..... 241/148, 241/101.74, 101.742, 101.77, 207–216, 264–269
See application file for complete search history.

(56) References Cited

U.S. PATENT DOCUMENTS

| | | | | |
|---|---|---|---|---|
| 3,425,639 | A | 2/1969 | Kueneman | |
| 3,479,904 | A | 11/1969 | Winter | |
| 3,959,897 | A * | 6/1976 | May | 37/319 |
| 4,398,674 | A | 8/1983 | Dremann | |
| 4,418,872 | A | 12/1983 | Nelson | |
| 4,989,797 | A | 2/1991 | DeDiemar et al. | |
| 5,110,058 | A | 5/1992 | Rawson | |
| 5,482,218 | A | 1/1996 | Ha | |
| 6,915,972 | B2 * | 7/2005 | Rossi, Jr. | 241/101.72 |
| 7,222,807 | B2 * | 5/2007 | Azzolin | 241/201 |
| 2005/0242220 | A1 | 11/2005 | Azzolino | |
| 2006/0202075 | A1 | 9/2006 | Young et al. | |

FOREIGN PATENT DOCUMENTS

| | | |
|---|---|---|
| DE | 495053 | 4/1930 |
| EP | 0 201 477 | 12/1986 |
| EP | 0 444 019 | 10/1993 |
| GB | 220860 | 8/1924 |

(Continued)

OTHER PUBLICATIONS

International Search Report and Written Opinion based on International Patent Application No. PCT/CA2011/000841; dated Nov. 3, 2011.

*Primary Examiner* — Mark Rosenbaum
(74) *Attorney, Agent, or Firm* — Fasken Martineau DuMoulin LLP

(57) ABSTRACT

The present invention relates to the field of rock crushers, in particular, rock crusher attachments for earth moving equipment or the like. The rock crusher attachment includes a front bucket portion configured for scooping rocks to be crushed and a rear crusher portion connected to and in communication with the rear of the bucket portion. The crusher portion includes a housing and a crushing assembly accommodated within the housing. The housing including a pair of spaced apart side panels. The crushing assembly has a lower jaw fixed between the side panels of the housing and an upper movable jaw mounted opposite and spaced apart from the lower jaw. The upper movable jaw assembly includes a support, an upper jaw plate attached to the underside of the support and a jaw-actuating drive assembly operable to urge the upper movable jaw assembly to move between an open jaw setting and a closed jaw setting. The support is pivotally connected between the side panels adjacent the front of the housing. The jaw-actuating drive assembly includes at least one motor carried by the support. The at least one motor is urged to move along with the upper movable jaw assembly relative to the lower jaw, when the crusher assembly is actuated.

33 Claims, 22 Drawing Sheets

FOREIGN PATENT DOCUMENTS

| | | |
|---|---|---|
| GB | 239587 | 9/1925 |
| GB | 1024355 | 3/1966 |
| JP | 2009045529 | 3/2009 |
| WO | WO2006/072322 | 7/2006 |
| WO | WO2006/072323 | 7/2006 |
| WO | WO2006/094548 | 9/2006 |
| WO | WO2006/105864 | 10/2006 |
| WO | WO2008/010072 | 1/2008 |
| WO | WO2009/031296 | 3/2009 |

* cited by examiner

ROCK CRUSHER ATTACHMENT

FIELD OF THE INVENTION

The present invention relates to the field of rock crushers, in particular, rock crusher attachments for earthmoving vehicles or the like.

BACKGROUND OF THE INVENTION

Rotary crushers are used in a variety of mining applications as well as in construction/demolition settings. A typical rotary crusher has a housing made of steel plate, a first fixed jaw and a second movable jaw positioned facing each other inside the housing. When the rotary crusher is actuated, the second movable jaw is urged to move between an open jaw setting (where the gap between the first end of the second movable jaw and the fixed jaw is at its greatest) and a closed jaw setting (where the gap between first end of the second movable jaw and the fixed jaw is at its smallest). When the second movable jaw in the closed jaw setting, a crushing force is delivered to the rock held between the jaws.

Different mechanisms have been used to actuate the movable jaw. One known mechanism employs a hydraulic motor and a drive belt and pulley arrangement operatively connected to a drive shaft. A pair of eccentrics is arranged on the drive shaft. Each eccentric is provided with a bearing. A hollow sleeve fixed to the movable jaw fits on the bearings and can freely rotate about the bearings. When the hydraulic motor is actuated, rotary motion is transferred through the drive belt and pulley arrangement to the drive shaft. As the shaft rotates, the eccentrics bear against the sleeve and a rotational/translational movement is imparted to the movable jaw thereby urging the movable jaw closer to fixed jaw to deliver the crushing force. Also provided is an adjustment mechanism for adjusting the cross-section of the discharge outlet of the crusher. The adjustment mechanism takes the form of a strut and one or more spacers interposed between the frame of the movable jaw and a portion of the crusher housing. A spring member holds the adjustment mechanism in place during the movement of the jaw.

Other known actuating mechanisms employ an arrangement of drive motor, eccentric shaft and toggle mechanism. The drive motor is connected to one end of the eccentric shaft, while a flywheel is rigidly fixed to the opposite end of the eccentric shaft. A pitman is held against the eccentric shaft and is arranged to bear against the toggle pin of the toggle mechanism. The toggle mechanism is defined by the toggle pin and a pair of opposed first and second toggle plates disposed in bearing engagement with toggle pin. Each toggle plate is mounted to extend between the toggle pin and a toggle seat. The toggle seat of the first toggle plate is carried on the crusher housing, while the toggle seat of the second plate is supported on the movable jaw. All the parts of the toggle mechanism are held firmly together by springs. When the crusher is actuated, the drive motor causes the eccentric shaft to rotate. The rotary motion urges the displacement of the pitman thereby causing the toggle plates to reciprocate and the movable jaw to pivot towards the fix jaw. A pull back spring mechanism is also provided to bias the movable jaw in the open setting position.

Crushers using the known jaw actuating mechanisms described above have tended to have only partial success in the field. While they tend to be generally effective at crushing softer rock in the range of 20,000 to 25,000 psi hardness, they have tended not to perform as well in applications requiring harder rock to be crushed. In some cases where attempts were made to crush harder rock using such crushers, the crusher mechanism lacked the requisite crushing power to crush the rock, and stalled. Worse still, in some extreme cases, the frames supporting the moving and fixed jaws flexed under the stress of crushing the harder rock, and failed.

Another drawback associated with these types of crushers is their inability to crush relatively large volumes of rock in a short period of time (i.e. that is more than 50 tons per hour), without substantially increasing the size of the crushing mechanism (and consequently, the cost of the crusher).

For reasons of versatility, it is desirable to have a crusher whose crushing mechanism is capable of being adjusted to produce crushed rock of a smaller or larger size, as required. While some of the crushers of the type described above have this capability, adjusting the crushing mechanism to increase or reduce the crushing size can be a complicated, labour-intensive and time-consuming task, in some cases, requiring two or more workers several hours of work to complete. Moreover, due to its complexity, such work tends not to be performed in the field and usually needs to be carried out at a maintenance/repair facility.

Based on the foregoing, there is a real need for a ruggedly built rock crusher that is powerful enough to crush relatively large volumes of hard rock in a short period of time. Preferably, the crusher mechanism of such a rock crusher would be configured to allow for the size of the crushed rock produced to be quickly and easily adjusted to suit particular field applications.

SUMMARY OF THE INVENTION

According to a broad aspect of an embodiment of the present invention, there is provided a rock crusher. The rock crusher includes a front bucket portion configured for scooping rocks to be crushed and a rear crusher portion connected to and in communication with the rear of the bucket portion. The crusher portion includes a housing and a crushing assembly accommodated within the housing. The housing includes a pair of spaced apart side panels. The crushing assembly has a lower jaw fixed between the side panels of the housing and an upper movable jaw mounted opposite and spaced apart from the lower jaw. The upper movable jaw assembly includes a support, an upper jaw plate attached to the underside of the support and a jaw-actuating drive assembly operable to urge the upper movable jaw assembly to move between an open jaw setting and a closed jaw setting. The support is pivotally connected between the side panels adjacent the front of the housing. The jaw-actuating drive assembly includes at least one motor carried by the support. The at least one motor is urged to move along with the upper movable jaw assembly relative to the lower jaw, when the crusher assembly is actuated.

In an additional feature, the jaw-actuating drive assembly further includes an eccentric operatively coupled to the at least one motor for rotation, a double toggle plate arrangement mounted between the support and a top portion of the housing, and a stroke arm disposed between and connected to each of the eccentric and the double toggle plate arrangement for transferring motion from the eccentric to the double toggle plate arrangement.

In one feature, during actuation of the crusher assembly, the double toggle plate arrangement is on center when the stroke arm has reached the end of its stroke. In an alternate feature, during actuation of the crusher assembly, the double toggle plate arrangement is over center when the stroke arm has reached the end of its stroke.

In a further feature, the double toggle plate arrangement has an upper toggle plate, a lower toggle plate, and a cylindrical shaft disposed between and in bearing engagement with the upper and lower toggle plates. The shaft is attached to the stroke arm. Additionally, the upper toggle plate has an upper edge and a lower edge. The upper edge of the upper toggle plate has a first roller member fixed thereto. The lower edge of the upper toggle plate has a first arcuate plate fixed thereto. The radius of curvature of the first arcuate contact plate is configured to correspond to the radius of curvature of the shaft. The lower toggle plate has an upper edge and a lower edge. The upper edge of the lower toggle plate has a second arcuate plate fixed thereto. The radius of curvature of the second arcuate contact plate is configured to correspond to the radius of curvature of the shaft. The lower edge of the lower toggle plate has a second a roller member fixed thereto.

In yet another feature, the crusher assembly is further provided with a first seat member configured to receive the first roller member and a second seat member configured to receive the second roller member. The first seat member is carried between the side panels and defines at least partially the top portion of the housing. The second seat member is carried on the support.

In one feature, the first seat member has a slanted orientation and is inclined forwardly relative to a vertical axis.

In still another feature, the crusher assembly further includes an upper bearing block disposed within the first seat member. The upper bearing block is configured for bearing engagement with the first roller member. Optionally, the crusher assembly may further include at least one shim for insertion between the first seat member and the upper bearing block for spacing the upper bearing block from the first seat member.

In a further feature, the support has a base and a plane P that intersects the base. The second seat member is angled relative to the plane P of the base. In another feature, the crusher assembly further includes a lower bearing block disposed within the second seat member. The lower bearing block is configured for bearing engagement with the second roller member. Optionally, the crusher assembly may further include a dampening pad for insertion between the second seat member and the lower bearing block.

In yet another feature, the double toggle plate arrangement is moveable between a flexed position and a fully extended position. When the double toggle plate arrangement is in the flexed position, the upper toggle plate has a skewed orientation relative to the lower toggle plate and the movable jaw assembly is in the open jaw setting. When the double toggle plate arrangement is in the fully-extended position, the upper toggle plate is in planar alignment with lower toggle plate and the movable jaw assembly is in the closed jaw setting.

In still another feature, the jaw-actuating drive assembly further includes a biasing assembly operable to maintain the double toggle plate arrangement in the flexed position. The biasing assembly is hydraulics-based and includes a hydraulic cylinder connected between the top portion of the housing and the carriage. In a further feature, the hydraulic cylinder includes a body, a piston rod mounted to extend within the body and a piston accommodated within the body and connected to the piston rod. The piston rod is moveable between a retracted position and an extended position. The body is pivotally attached to one of the support and the top portion of the housing and the piston rod is pivotally attached to the other of the support and the top portion of the housing. In one feature, the piston rod is in the extended position when the double toggle plate arrangement is in its fully-extended position. In another feature, the biasing assembly further includes an accumulator in fluid communication with the hydraulic cylinder, a reservoir for storing hydraulic fluid and a pump operable to charge the accumulator with hydraulic fluid from the reservoir.

In a further feature, the double toggle plate arrangement further includes means for discouraging dislocation of the shaft from between the upper and lower toggle plates. The means for discouraging dislocation of the shaft includes at least one guard member located in front of the shaft and at least one guard member located rearward of the shaft.

In one feature, the at least one motor includes first and second motors operatively coupled to either ends of the eccentric.

In another feature, the crusher assembly has a discharge outlet defined between the upper jaw plate and the lower jaw at the rear of the housing and further includes means for adjusting the size of the discharge outlet.

According to another broad aspect of an embodiment of the present invention, there is provided a rock crusher attachment for an earthmoving vehicle. The rock crusher attachment includes a front bucket portion configured for scooping rocks to be crushed and a rear crusher portion connected to and in communication with the rear of the bucket portion. The crusher portion includes a housing and a crushing assembly accommodated within the housing. The housing has a pair of spaced apart side panels. The crushing assembly includes a lower jaw fixed between the side panels of the housing and an upper movable jaw mounted opposite and spaced apart from the lower jaw. The upper movable jaw assembly is pivotally connected between the side panels adjacent the front of the housing. The upper movable jaw assembly includes a support, an upper jaw plate attached to the underside of the support and a jaw-actuating drive assembly carried on the support. The jaw-actuating drive assembly is operable to urge the upper movable jaw assembly to move between an open jaw setting and a closed jaw setting. The jaw-actuating drive assembly being urged to move along with upper movable jaw assembly relative to the lower jaw, when the crusher assembly is actuated.

According to yet another broad aspect of an embodiment of the present invention, there is provided a rock crusher attachment for an earthmoving vehicle. The rock crusher attachment includes a front bucket portion configured for scooping rocks to be crushed and a first rear crusher portion connected to and in communication with the rear of the bucket portion. The first crusher portion includes a first housing and a first crushing assembly accommodated within the first housing. The first housing includes a pair of spaced apart side panels. The crushing assembly includes a first lower jaw fixed between the side panels of the first housing and a first upper movable jaw mounted opposite and spaced apart from the first lower jaw. The first upper movable jaw assembly includes a first support and a first upper jaw plate attached to the underside of the first support. The first support is pivotally connected between the side panels of the first housing adjacent the front thereof.

Also provided is a second rear crusher portion connected to and in communication with the rear of the bucket portion. The second crusher portion is spaced away from the first crusher portion. The second crusher portion includes a second housing and a second crushing assembly accommodated within the second housing. The second housing includes a pair of spaced apart side panels. The second crushing assembly includes a second lower jaw fixed between the side panels of the second housing and a second upper movable jaw mounted opposite and spaced apart from the second lower jaw. The second movable upper jaw assembly includes a second support and a second upper jaw plate attached to the underside of the second support. The second support is pivotally connected between the side panels of the second housing adjacent the front thereof.

The rock crusher attachment also includes a jaw-actuating drive assembly extending between the first and second crusher assemblies. The jaw-actuating assembly is operable to urge the first and second upper movable jaw assemblies to move between their respective open jaw settings and closed jaw settings. The jaw-actuating drive assembly includes a first drive subassembly associated with the first crusher assembly, a second drive subassembly associated with the second crusher assembly and a mechanism for transmitting rotary motion between the first drive subassembly and the second drive subassembly. The first drive subassembly includes a first motor carried by the first support. The first motor is urged to move along with the first upper movable jaw assembly relative to the first lower jaw, when the first crusher assembly is actuated. The second drive subassembly includes a second motor carried by the second support. The second motor is urged to move along with the second upper movable jaw assembly relative to the second lower jaw, when the second crusher assembly is actuated.

In a further feature, the first drive subassembly further includes a first eccentric operatively coupled to the first motor for rotation, a first double toggle plate arrangement mounted between the first support and a top portion of the first housing, and a first stroke arm disposed between and connected to each of the first eccentric and the first double toggle plate arrangement for transferring motion from the first eccentric to the first double toggle plate arrangement. The second drive subassembly further includes a second eccentric operatively coupled to the second motor for rotation, a second double toggle plate arrangement mounted between the second support and a top portion of the second housing, and a second stroke arm disposed between and connected to each of the second eccentric and the second double toggle plate arrangement for transferring motion from the second eccentric to the second double toggle plate arrangement. The mechanism for transmitting rotary motion between the first drive subassembly and the second drive subassembly is a universal joint assembly. The universal joint assembly has a first portion operatively coupled to the first eccentric and a second portion operatively coupled to the second eccentric.

In another feature, the first eccentric is rotationally out-of-phase relative to the second eccentric, preferably, by an angle of 180 degrees.

In still another feature, the front bucket portion includes a centrally disposed V-shaped blade portion for directing rocks to be crushed to the first and second rear crusher portions.

According to still another broad aspect of an embodiment of the present invention, there is provided a rock crusher attachment for an earthmoving vehicle. The rock crusher attachment has a front bucket portion configured for scooping rocks to be crushed and a first rear crusher portion connected to and in communication with the rear of the bucket portion. The first crusher portion includes a first housing and a first crushing assembly accommodated within the first housing. The first housing includes a pair of spaced apart side panels. The first crushing assembly includes a first lower jaw fixed between the side panels of the first housing and a first upper movable jaw mounted opposite and spaced apart from the first lower jaw. The first upper movable jaw assembly includes a first support, a first upper jaw plate attached to the underside of the first support and a first jaw-actuating drive assembly operable to urge the upper movable jaw assembly to move between an open jaw setting and a closed jaw setting. The first support is pivotally connected between the side panels of the first housing adjacent the front thereof. The first jaw-actuating drive assembly includes at least one motor carried by the first support. The at least one motor of the first jaw-actuating assembly is urged to move along with the first upper movable jaw assembly relative to the first lower jaw, when the first crusher assembly is actuated.

Also provided is, a second rear crusher portion connected to and in communication with the rear of the bucket portion. The second crusher portion is spaced away from the first crusher portion. The second crusher portion includes a second housing and a second crushing assembly accommodated within the second housing. The second housing includes a pair of spaced apart side panels. The second crushing assembly including a second lower jaw fixed between the side panels of the second housing and a second upper movable jaw mounted opposite and spaced apart from the second lower jaw. The second upper movable jaw assembly includes a second support, a second upper jaw plate attached to the underside of the second support and a second jaw-actuating drive assembly operable to urge the upper movable jaw assembly to move between an open jaw setting and a closed jaw setting. The second support is pivotally connected between the side panels of the second housing adjacent the front thereof. The second jaw-actuating drive assembly includes at least one motor carried by the second support. The at least one motor of the second jaw-actuating assembly is urged to move along with the second upper movable jaw assembly relative to the second lower jaw, when the second crusher assembly is actuated.

BRIEF DESCRIPTION OF THE DRAWINGS

The embodiments of the present invention shall be more clearly understood with reference to the following detailed description of the embodiments of the invention taken in conjunction with the accompanying drawings, in which.

DETAILED DESCRIPTION OF EMBODIMENTS OF THE INVENTION

Figure 1:
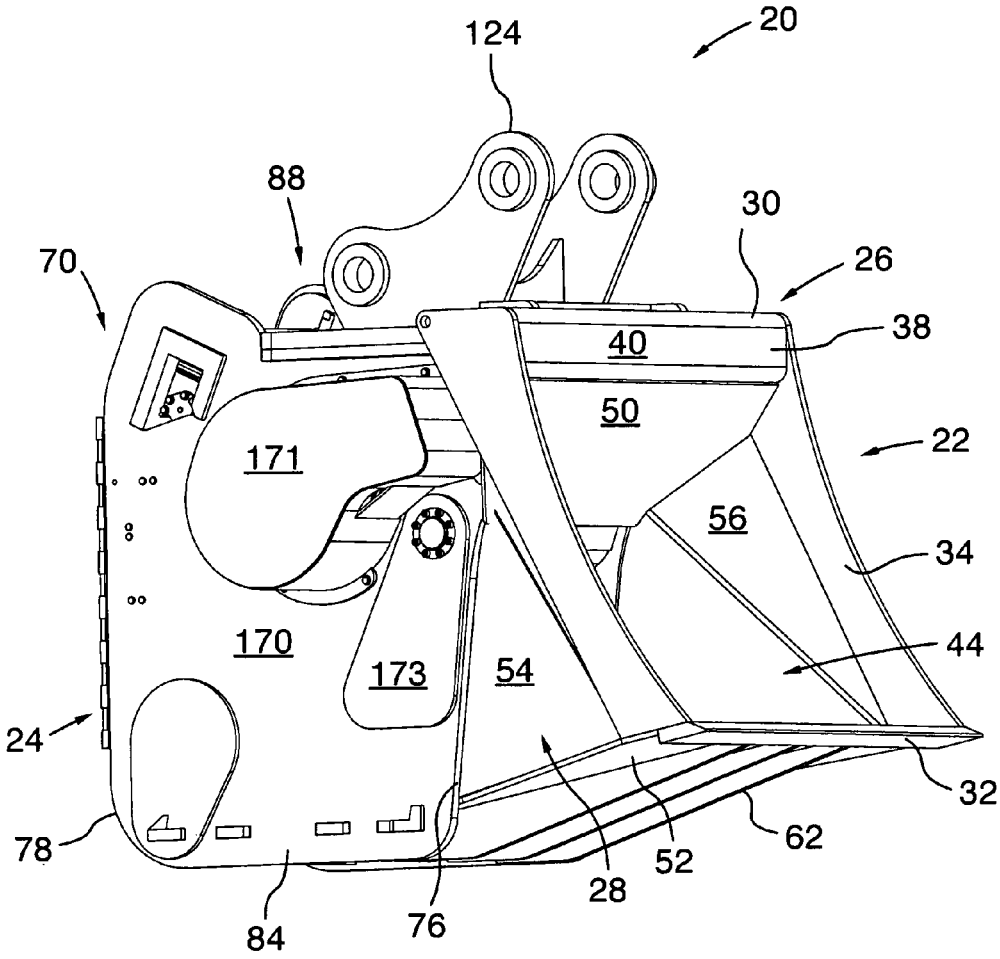
FIG. 1 is a front left perspective view of a rock crusher attachment in accordance with an embodiment of the invention showing a front bucket portion joined to a rear crushing portion.
Figure 2:
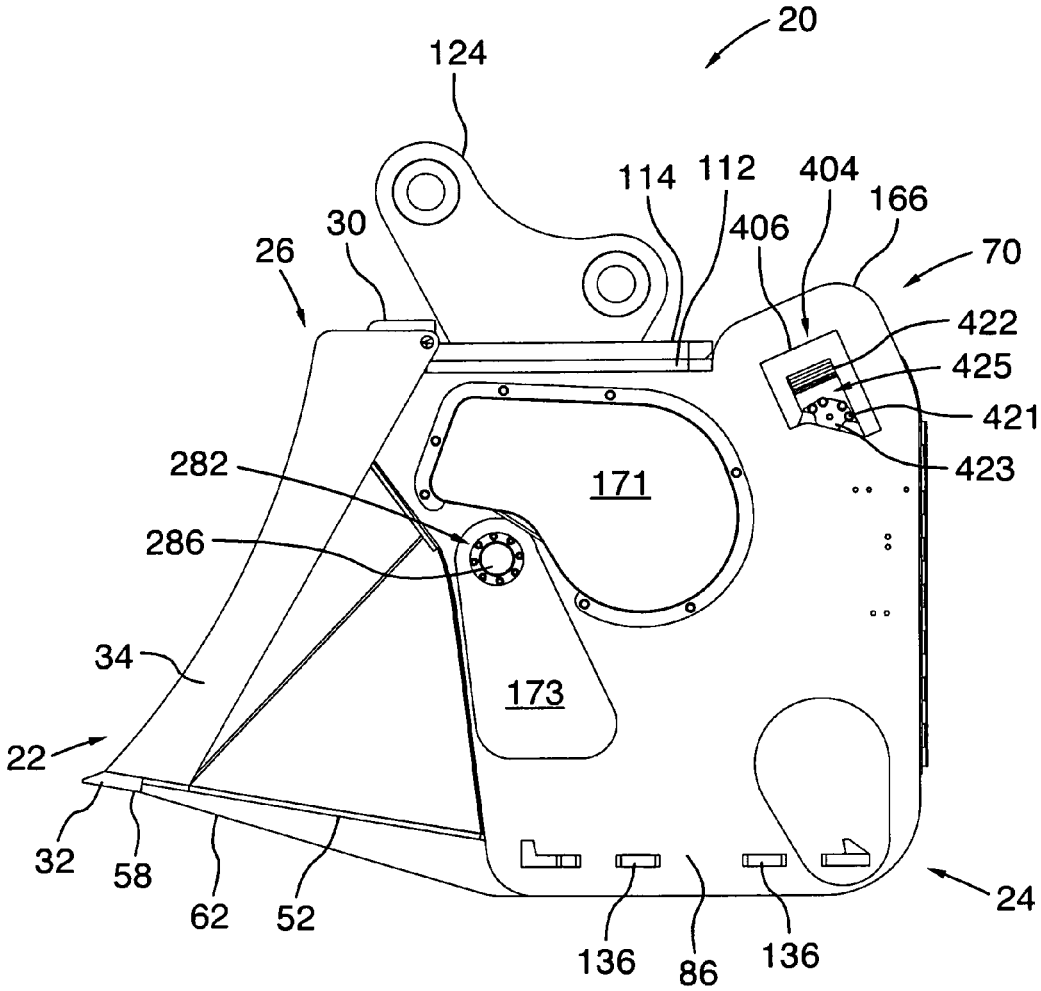
FIG. 2 is a right side elevation view of the rock crusher attachment illustrated in FIG. 1.

The description, which follows, and the embodiments described therein are provided by way of illustration of an example, or examples of particular embodiments of principles and aspects of the present invention. These examples are provided for the purposes of explanation and not of limitation, of those principles of the invention. In the description that follows, like parts are marked throughout the specification and the drawings with the same respective reference numerals.

Referring to FIGS. 1 to 6, there is shown a rock crusher attachment designated generally with reference numeral 20. The rock crusher attachment 20 is designed to be suspended from or carried on the boom (not shown) of an earthmoving vehicle, such as an excavator, a backhoe, a loader, or the like. The rock crusher attachment 20 has a front bucket portion 22 and a rear crusher portion 24 joined thereto. The front bucket portion 22 is provided with a frame 26 welded to a bucket body 28. The frame 26 includes a top frame member 30, an opposed bottom blade-like lip member 32 and a pair of spaced apart, vertically extending, elongate side frame members 34 and 36 which join the top frame member 30 to the bottom lip member 32. In this embodiment, the top frame member 30 is in the nature of a C-shaped structural member 38 with its back 40 oriented frontward and its arms extending 42 rearward (see FIG. 9). A relatively large, substantially square, intake opening 44 is defined in the frame 26 for receiving rocks to be crushed 46 (shown in FIG. 11*a*). The intake opening 44 provides access to the bucket body 28.

Figure 4:
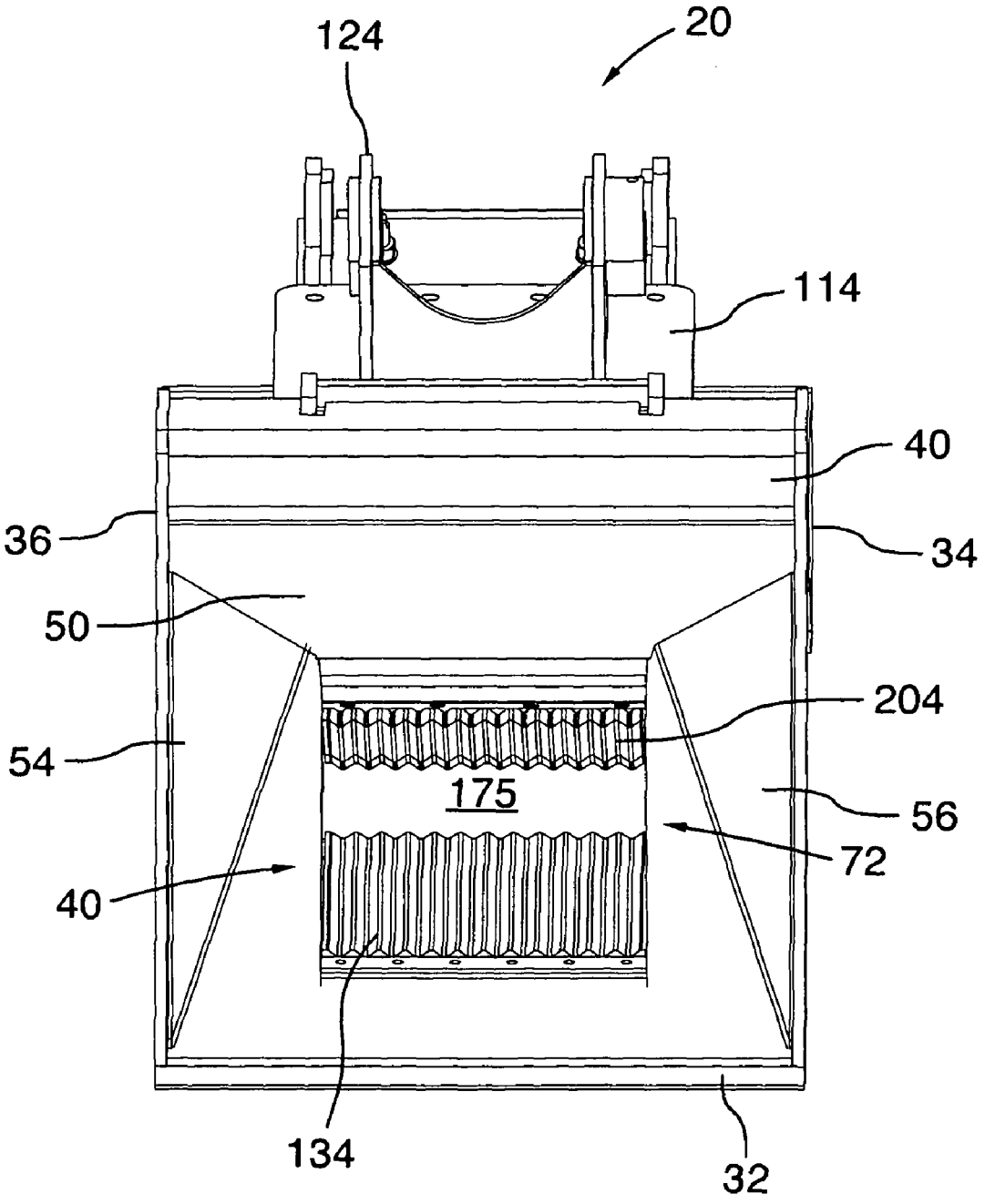
FIG. 4 is a front end view of the rock crusher attachment illustrated in FIG. 3 taken in the direction of arrow "3" looking into the bucket portion of the rock crusher attachment and showing the opposed first and second jaws disposed therein.

The bucket body 28 is defined by a top panel 50, a bottom panel 52, and inwardly and rearwardly extending side panel portions 54 and 56. The uppermost margin of the top panel 50 is welded to the lower most margin of the top frame member 30. Portions of the side edges of the top panel 50 are also welded to the side frame members 34 and 36. The side panel portions 54 and 56 are attached along their front edges to the side frame members 34 and 36. Lastly, the bottom panel 52 is welded to the bottom lip member 32 along its front edge 58. Arranged in this manner, the panels 50 and 52 and the panel portions 54 and 56 form a chute 60 within the bucket body 28. As best shown in FIG. 4, the chute 60 tapers in the rearward direction, and ultimately opens onto the rear crusher portion 24. To encourage travel of the rocks 46 toward the rear crusher portion 24, both the top and bottom panels 50 and 52 are downwardly sloping.

Three reinforcement ribs 62 are welded to the outer face of the bottom panel 52. The ribs 62 extend from the front edge 58 of the bottom panel 52 and project beyond the rear edge 64 thereof for attachment to the rear crusher portion 24.

Figure 6:
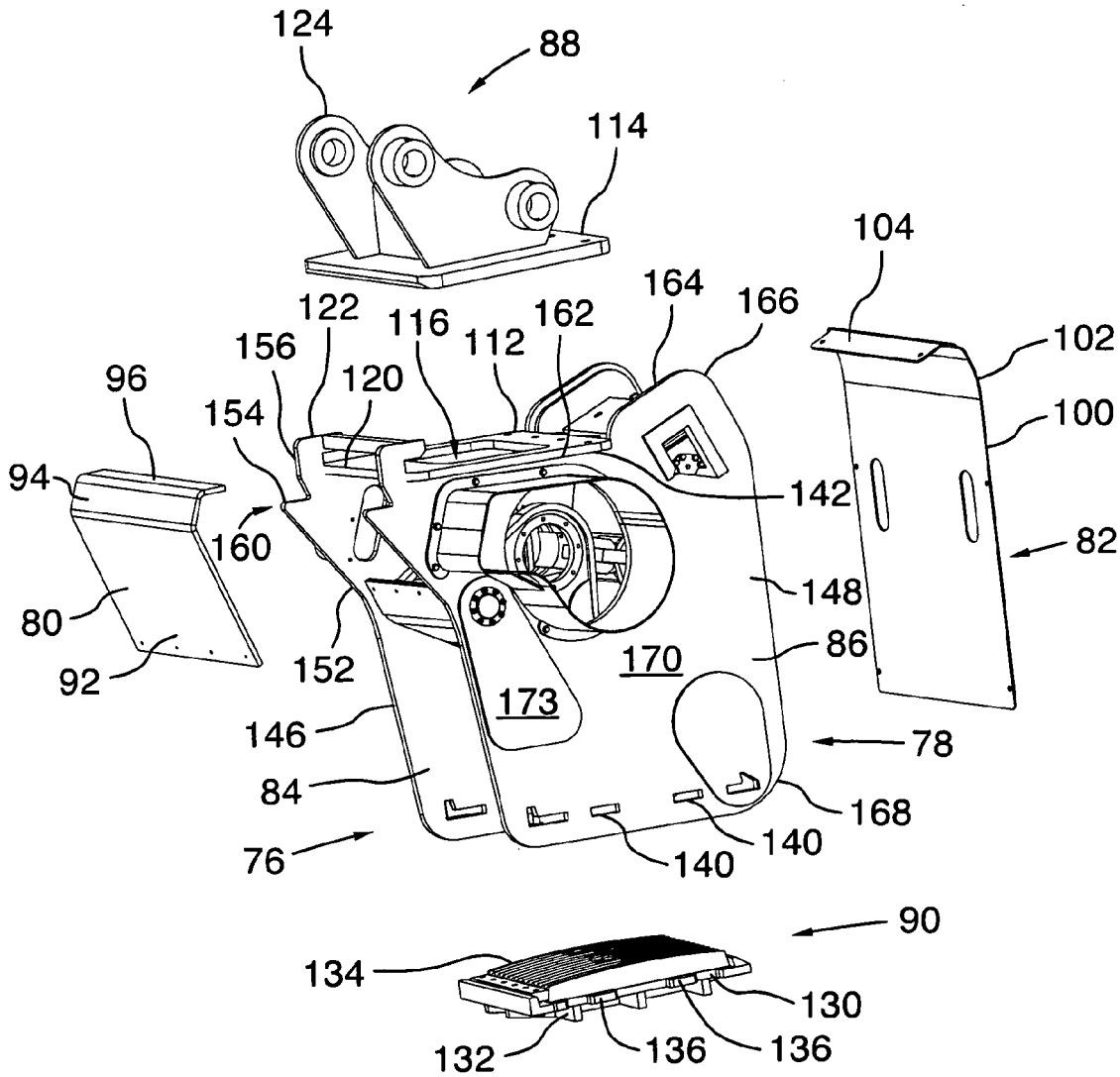
FIG. 6 is a front right perspective view of the rock crusher attachment illustrated in FIG. 1, with the front bucket portion removed and a portion of a protective panel on the side panel member of the housing removed for clarity, and the housing of the rear crusher portion shown partially exploded.

The rear crusher portion 24 has a housing 70 which accommodates a jaw-type crusher assembly 72. Referring to FIG. 6, the housing 70 has a front end 76 and rear end 78, and further includes a front protective face plate 80, an opposed rear protective face plate 82, two spaced apart, first and second side panel members 84 and 86, a top panel assembly 88 and a bottom panel assembly 90. The front and rear face plates 80 and 82, and each of the assemblies 88 and 90 extend between and the first side panel member 84 and the second side panel member 86 to connect one to the other.

The front protective face plate 80 is mounted at the front end 76 of the housing 70 adjacent the top panel assembly 88. It is relatively short and runs only about one third of the way down the first and second side panels 84 and 86. The front face plate 80 includes first, second and third plate portions 92, 94 and 96. The second plate portion 94 extends between the first and third plate portions 92 and 96 and is bent rearward relative to the first plate portion 92. The third plate portion 96 is also bent rearward relative to the second plate portion 94 and extends substantially horizontally away therefrom. During assembly of the front bucket portion 22 and the rear crusher portion 24, the distal ends of the arms 42 of the C-shaped member 38 are welded to the front face of face plate 80 adjacent the locations where the first plate portion 92 meets the second plate portion 94 and the second plate portion 94 meets the third plate portion 96 (see FIG. 10).

The rear face plate 82 is disposed at the rear end 78 of the housing 70 and extends from the top panel assembly 88 to a location roughly two thirds of the way down the first and second side panels 84 and 86. The rear face plate 82 includes first, second and third plate portions 100, 102 and 104. The second plate portion 102 extends between the first and third plate portions 100 and 104 and curves slightly rearward. The third plate portion 104 is also bent rearward relative to the second plate portion 102 and extends downwardly therefrom on an angle. The rear face plate 82 is hingedly mounted to the side panel member 84 along the lateral edge of the first plate portion 100.

Defined between the front and rear face plates 80 and 82, and the first and second side panel members 84 and 86, is a compartment 110 (best shown in FIGS. 10 and 11) which accommodates a portion of the crusher assembly 72.

The top panel assembly 88 includes first and second steel plates 112 and 114. The bottom face of the first plate 112 is welded to the top edges 142 of the first and second side panel members 84 and 86. The first plate 112 has a relatively large aperture 116 formed therein to allow access to the compartment 110. The second plate 114 is secured on top of the first plate 112 by fasteners. The front portion 120 of the second plate 114 is further captively retained by a pair of spaced part, bent, finger-like projections 122 which extend from top edge 142 of first and second side panel members 84 and 86. Welded to the top face 124 of the second plate 114 is a pair of quick attachment fittings or lugs 124 which serve to connect the rock crusher attachment 20 to the boom of an earthmoving vehicle.

Mounted opposite the top panel assembly 88 is the bottom panel assembly 90. The assembly 90 includes a plate 130 and a latticework of reinforcements 132 welded to the underside of the plate 130. The plate 130 supports the fixed lower jaw plate 134 of the crusher assembly 72 on its topside. The plate 130 has a plurality of support tabs 136 which project from each of its lateral edges 138 at spaced apart locations. The support tabs 136 are sized to fit within spaced apart slots 140 formed along the bottom margin of the side panel members 84 and 86. During assembly of the rear crusher portion 24, the support tabs 136 are inserted into the slots 140 and welded securely in place. This construction tends to enhance the structural integrity of the housing 70, thereby making it more robust, better able to withstand repeated impact and wear and less prone to deformation and structural failure.

The first and second side panel members 84 and 86 are identical to each other in all material respects. Each side panel member 84, 86 has a vaguely rectangular shape defined by a top edge 142, an opposed bottom edge 144 and a pair of front and rear edges 146 and 148 which run between the top and bottom edges 142 and 144. The front edge 146 includes first, second, third and fourth front edge portions 150, 152, 154 and 156. The first front edge portion 150 meets the bottom edge 144 at a first radiused corner 158 and runs upwardly therefrom with an orientation substantially perpendicular to the bottom edge 144. The first front edge portion 150 joins the second front edge portion 152 at a location closer to the top edge 142 than to the bottom edge 144. The second front edge portion 152 extends away from the first front edge portion 150 at a forward slant and connects with the relatively short, third front edge portion 154. The edge portion 154 retreats rearward from the second front edge portion 152 and extends horizontally to meet with the fourth front edge portion 156.

Figure 9:
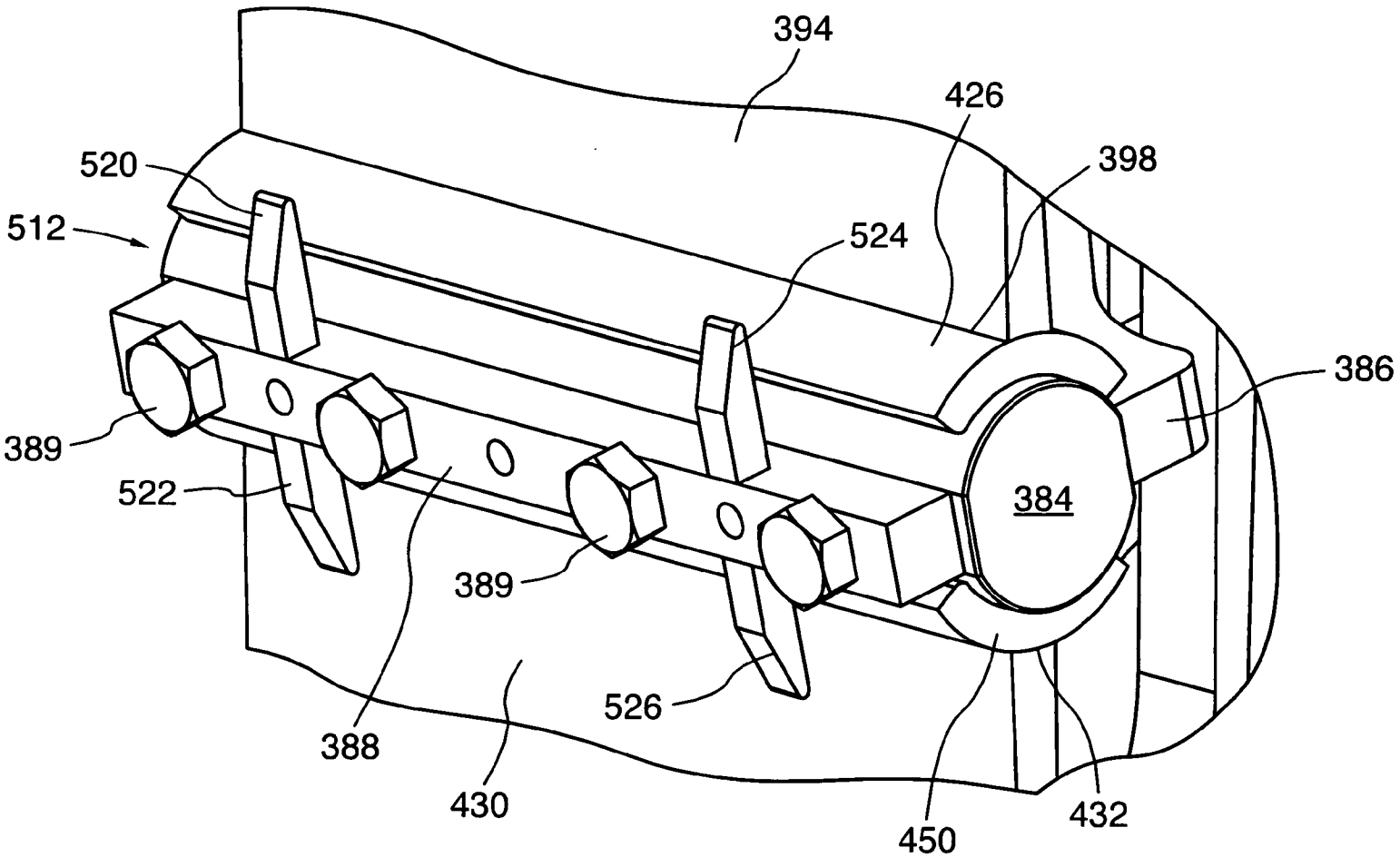
FIG. 9 is a rear, isolated perspective view of the double toggle plate arrangement shown in FIG. 8.

The second and third front edge portions 152 and 154 cooperate to define a fin-like or triangular projection 160 in the side panel member 84, 86. The apex of the projection 160 is formed by the juncture of the second and third front edge portions 150 and 154. As best shown in FIG. 9, the projection 160 abuts portions of the frame 26 and the bucket body 28 and serves as an attachment site for fixing the front bucket portion 22 to the rear crusher portion 24. More specifically, the rear face of the top panel 50 abuts, and is welded to, the second front edge portion 152 while the lower arm 42 of the C-shaped structural member 38 is supported by the projection 130 and welded thereto along the third front edge portion 154.

The fourth front edge portion 156 runs upwardly from the third front edge portion 154 and extends beyond the top edge 142 to define the rearwardly bent, finger-like projection 122. The top edge 142 includes a first top edge portion 162 and a second top edge portion 164. The first top edge portion 162 runs from the base of the finger-like projection 122 to meet the second top edge portion 164. The second top edge portion 164 extends generally upwardly and rearwardly from the first top edge portion 162 to define a bulging portion 166 at the rear of the housing 70 where the top edge 142 meets the rear edge 148. The rear edge 148 extends downwardly from the juncture with the top edge 142 to ultimately connect to the lower edge 144 at a second radiused corner 168.

Each side panel member 84, 86 has defined therein a first, relatively large aperture (not shown) which permits a portion of the drive assembly 207 to extend therethrough. This large aperture is concealed in the drawings by a protective enclosure 171 carried on the outer lateral face 170 of each side panel member 84, 86 below the top edge 142. Additionally, a second circular aperture 172 (visible in FIG. 6) defined by a circumferential edge 328 is formed in each side panel member 84 and 86. To reduce the forces acting on each side panel member 84, 86 in the area of the second aperture 172, a paddle-shaped reinforcement plate 173 is welded to the outer lateral face 170 of each side panel member 84 and 86.

The housing 70 and bucket portion 22 are fabricated from high strength, hardened steel plate thereby making the rock crusher attachment 20 robust. As a result, the rock crusher attachment 20 tends to be well suited to crush hard rock and better able to withstand wear and punishing impact/stresses.

Figure 13A:
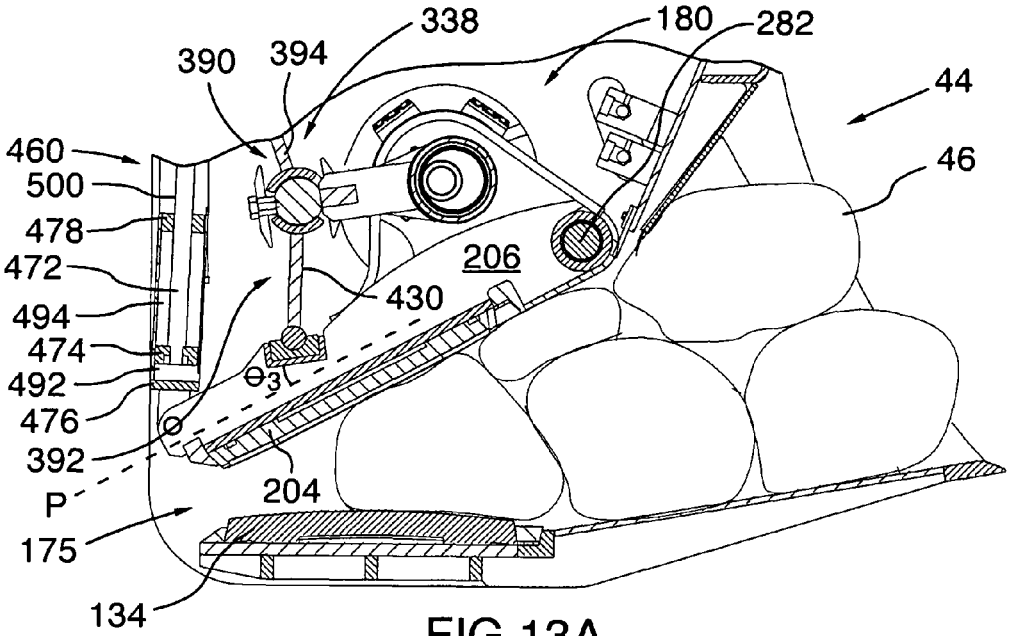
FIG. 13*a* is a partial view of the rock crusher attachment illustrated in FIG. 10 showing rocks loaded into the bucket portion of the rock crusher attachment.
Figure 13B:
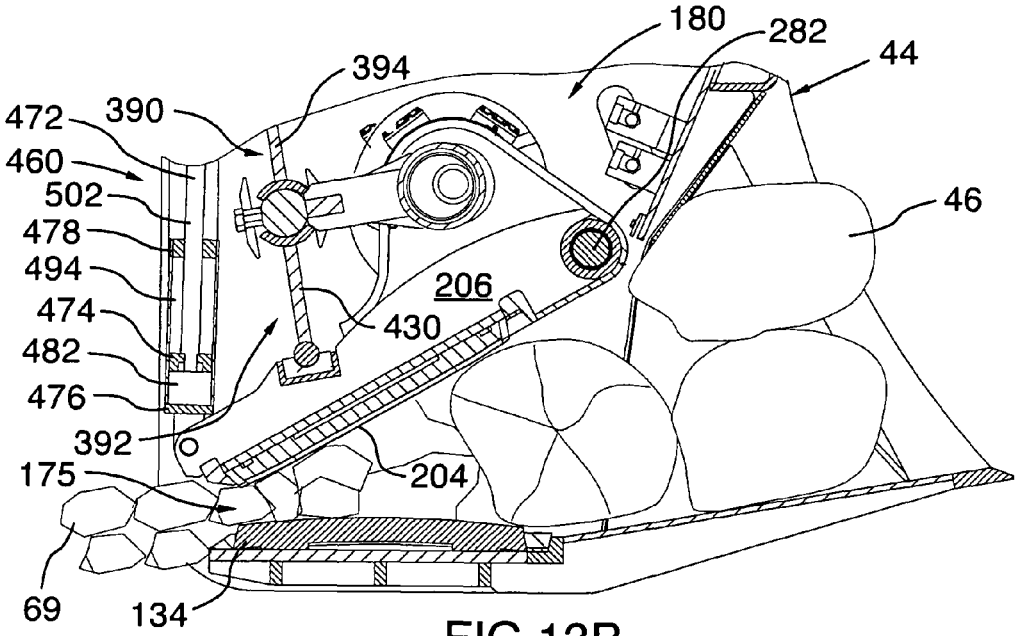
FIG. 13*b* is a partial view of the rock crusher attachment illustrated in FIG. 12*a* showing the rocks being crushed between the first and second jaws of the rock crusher attachment.
Figure 14:
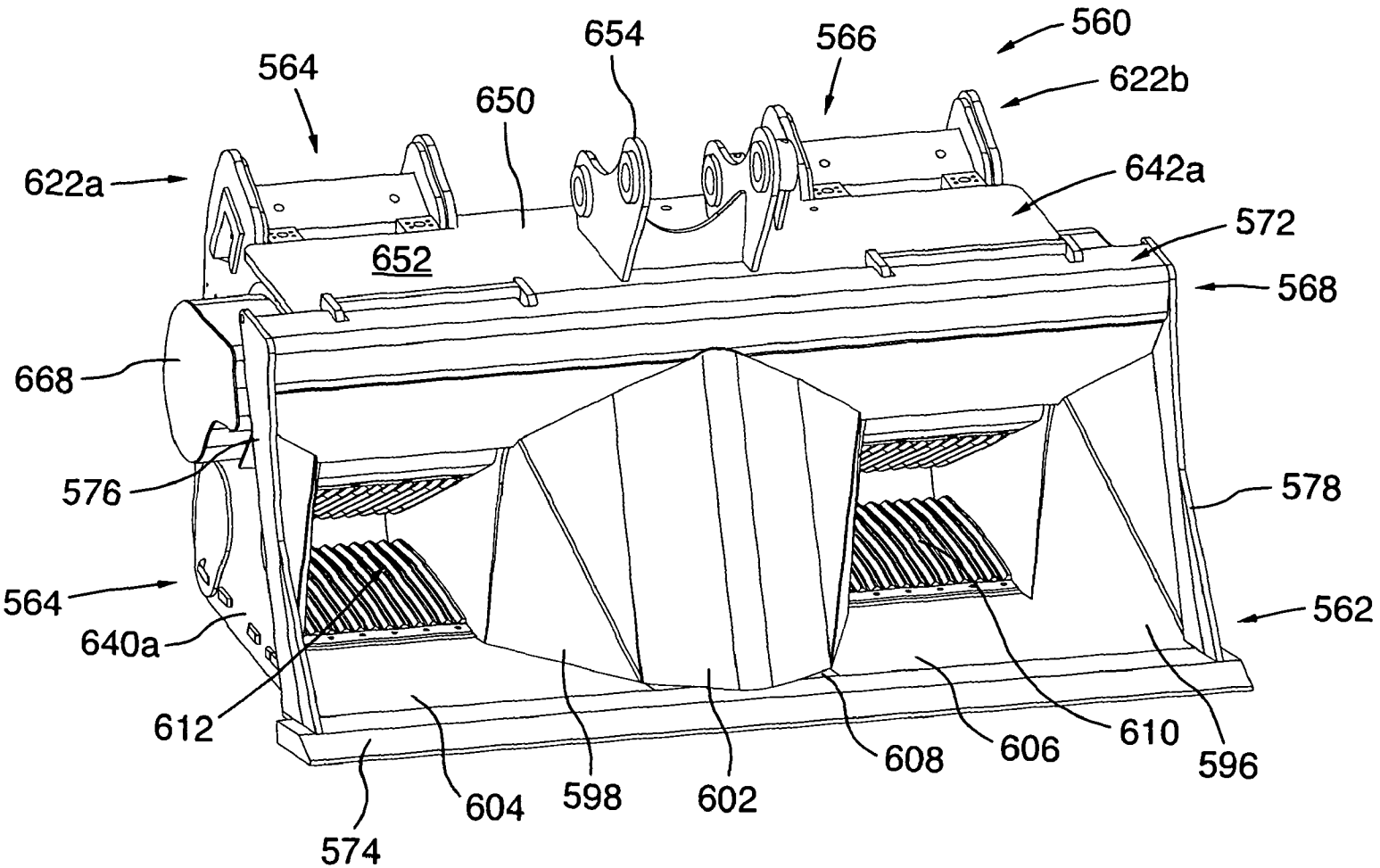
FIG. 14 is a front right perspective view of twin rock crusher attachment in accordance with another embodiment of the present invention.
Figure 15:
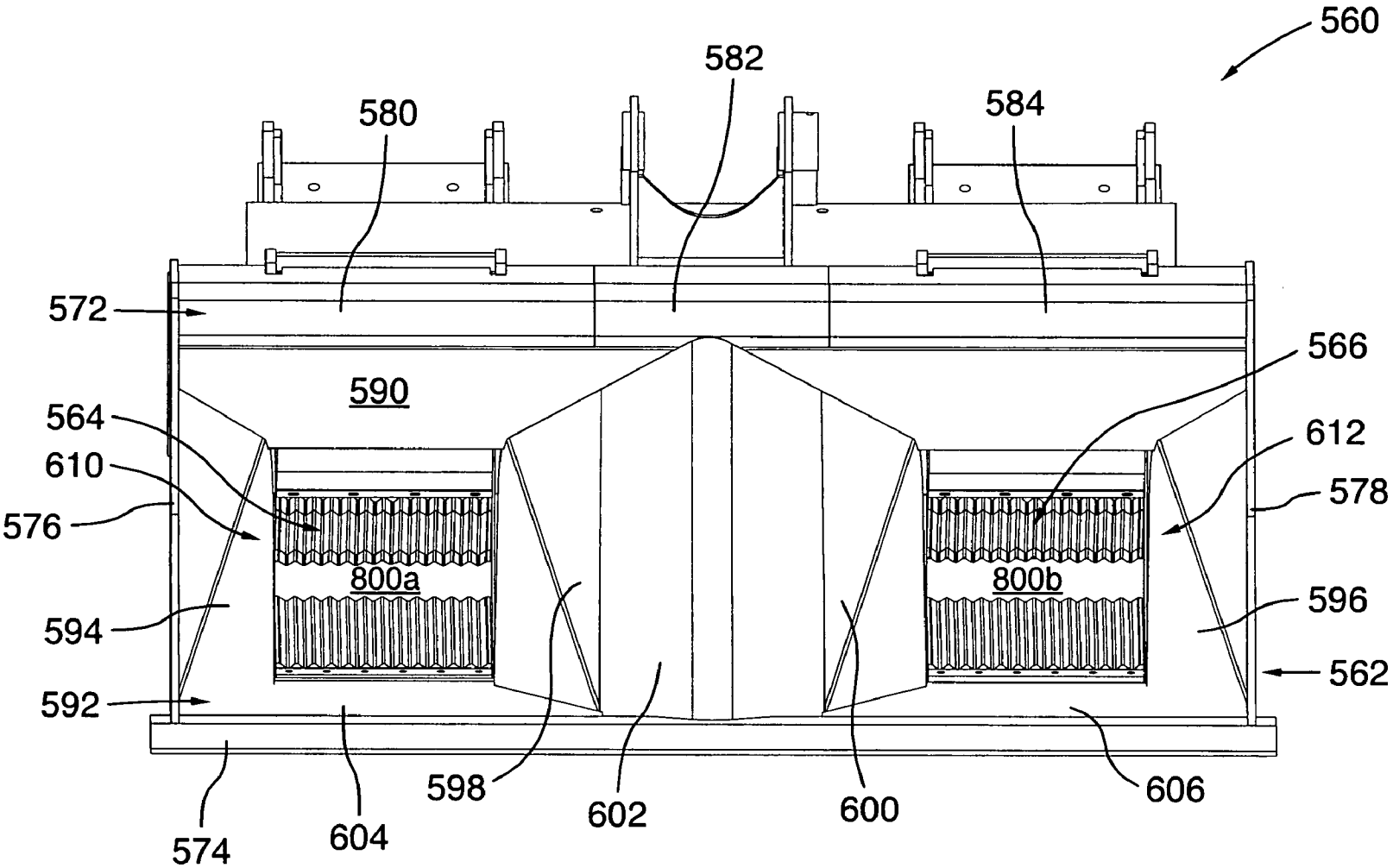
FIG. 15 is a front end view of the rock crusher attachment illustrated in FIG. 14 taken in the direction of arrow "15" looking into the bucket portion of the twin rock crusher attachment.

With reference to FIGS. 7 to 10, the crusher assembly 72 is now described in greater detail. The crusher assembly 72 includes the fixed lower jaw plate 134 and a movable upper jaw assembly 180 mounted opposite the lower jaw plate 134. The movable upper jaw assembly 180 is spaced apart from the lower jaw plate 134 such that a first intake gap or opening 174 is defined at the front end of the crusher assembly 72 for admitting rocks to be crushed 46 (shown in FIG. 13*a*) into the crusher assembly 72, and a second discharge gap or opening 175 is provided at the rear end of the crusher assembly 72 to allow the crushed rock 69 (shown in FIG. 13*b*) to be discharged from the crusher assembly 72. The upper jaw assembly 180 is pivotally connected to the housing 70 at its front end 76 and can be urged to move between an open jaw setting 176 (shown in FIGS. 10 and 13*a*) and a closed jaw setting 178 (shown in FIGS. 11 and 13*b*).

Because the upper jaw assembly 180 is fixed at the front end 76, the size of the intake opening 174 remains constant as the upper jaw assembly 180 moves between the open jaw setting 176 and the closed jaw setting 178. In this embodiment, the intake opening 174 is 16 in. high (as measured between the upper jaw plate 204 of the upper jaw assembly 180 and the lower jaw plate 134). In other embodiments, the intake opening could be sized bigger or smaller to suit a particular application. As will be explained in greater detail below, the size of the discharge opening 175 varies depending on the position of the movable upper jaw assembly 180 relative to the fixed lower jaw plate 134.

Figure 7:
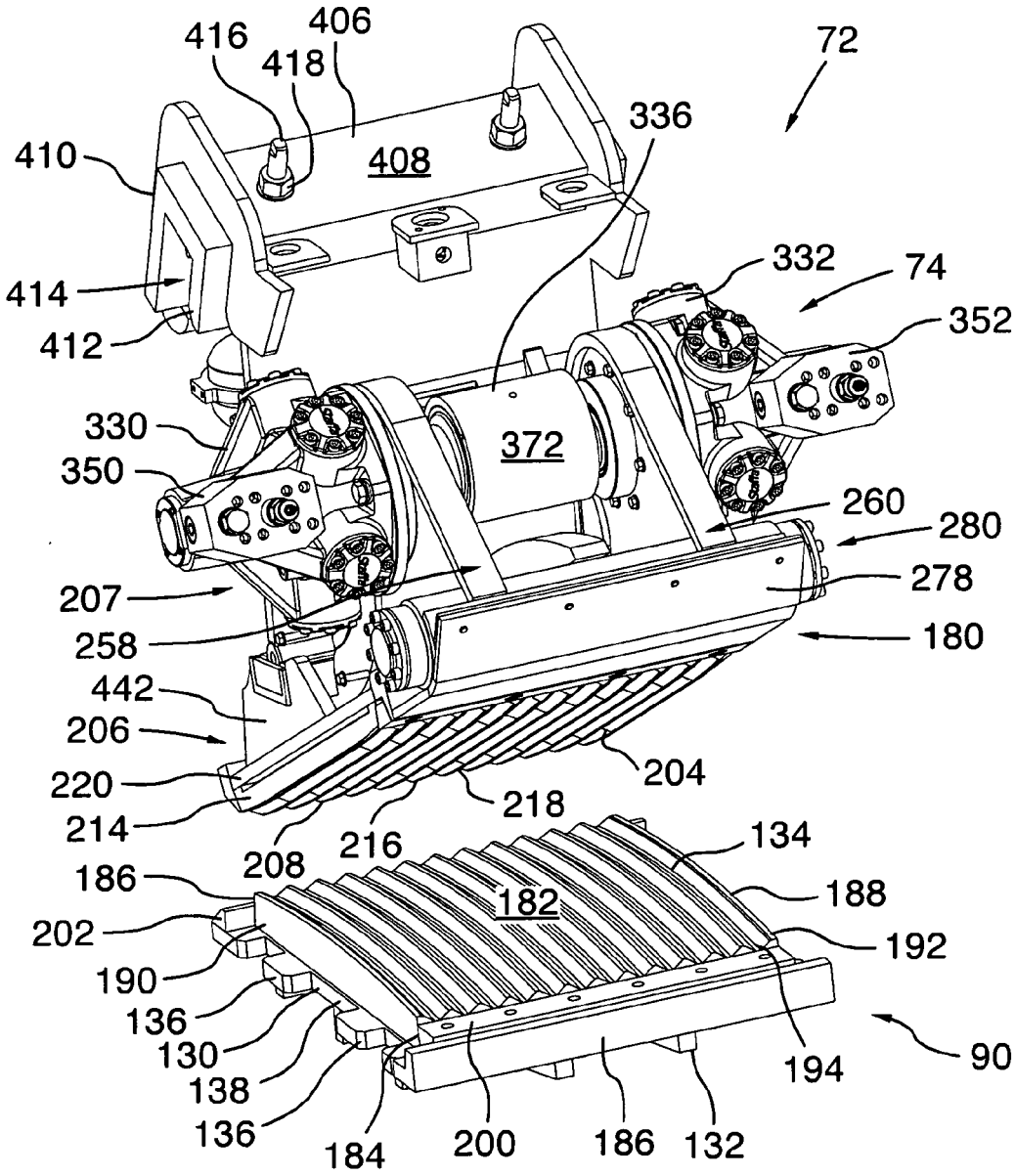
FIG. 7 is a front left perspective view of the rock crusher attachment shown in FIG. 1, with the front bucket portion and the housing of the rear crusher portion omitted to reveal details of the jaw-type crusher assembly and the drive assembly used to actuate same.
Figure 10:
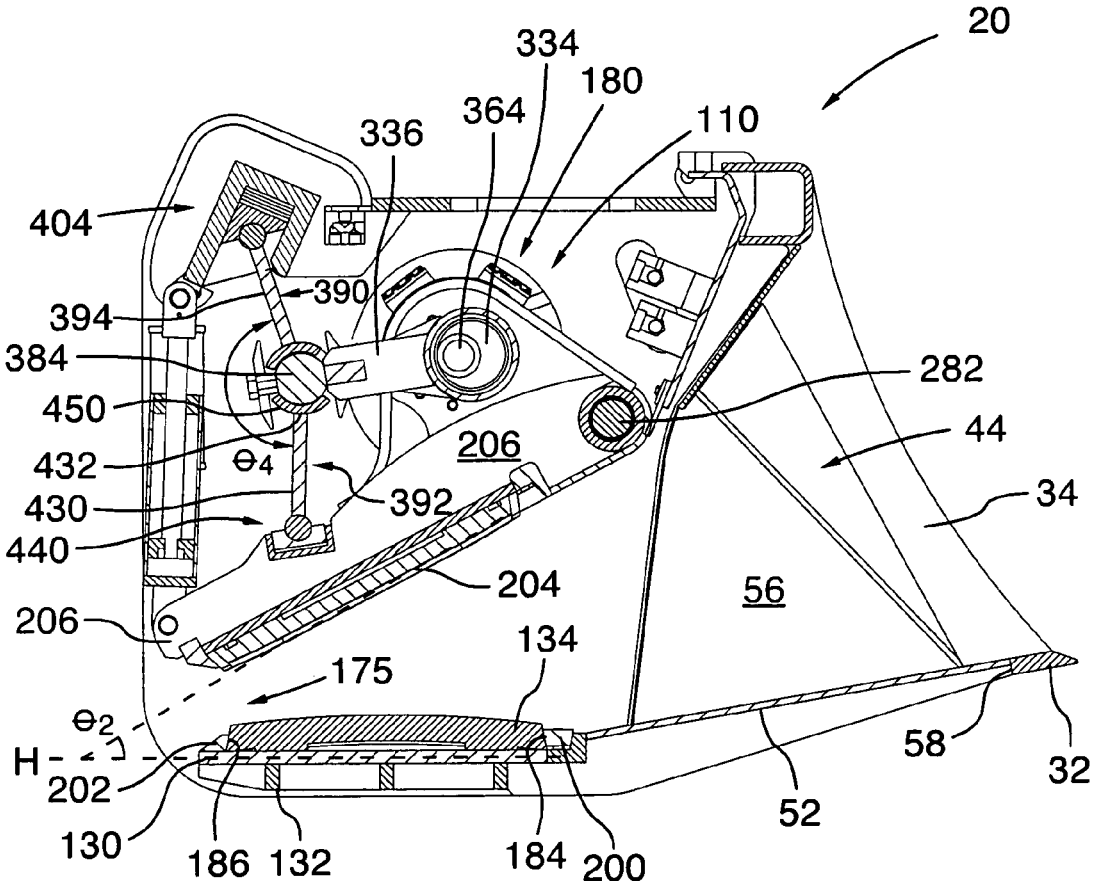
FIG. 10 is a cross-sectional view of the rock crusher attachment illustrated in FIG. 5 taken along line "10-10" showing the double toggle plate arrangement of the drive assembly in flexion.

Referring now to FIGS. 6, 7 and 10, the lower jaw plate 134 has an upper face 182, a lower face (not shown) and a generally rectangular footprint (when viewed in top plan view) that is defined by opposed front and rear edges 184 and 186 and first and second lateral edges 188 and 190. The upper surface 182 of the lower jaw plate 134 has a slightly convex profile (as best shown in FIG. 7) and is formed with an alternating arrangement of triangular ridges 192 and grooves 194 which extends between the lateral edges 188 and 190. Each ridge 192 and groove 194 runs from the front edge 184 to the rear edge 186. The lower jaw plate 134 is made of high manganese cast steel to enhance wear resistance and long service life.

As best shown in FIG. 10, the lower jaw plate 134 is fixedly retained on the plate 130 of the bottom panel assembly 90 by front and rear wedging members 200 and 202 which are adapted to conformingly engage the generally trapezoidal profile of the lower jaw plate 134. The rear wedging member 202 is welded onto the top face of plate 130 and abuts the rear edge 186 of the lower jaw plate 134. The front wedging member 200 bears against the front edge 184 of the lower jaw plate 134 and is attached to the bottom panel assembly 90 by a bracket 186 having a generally L-shaped profile. The bracket 186 is welded to the latticework of reinforcements 132.

Figure 8:
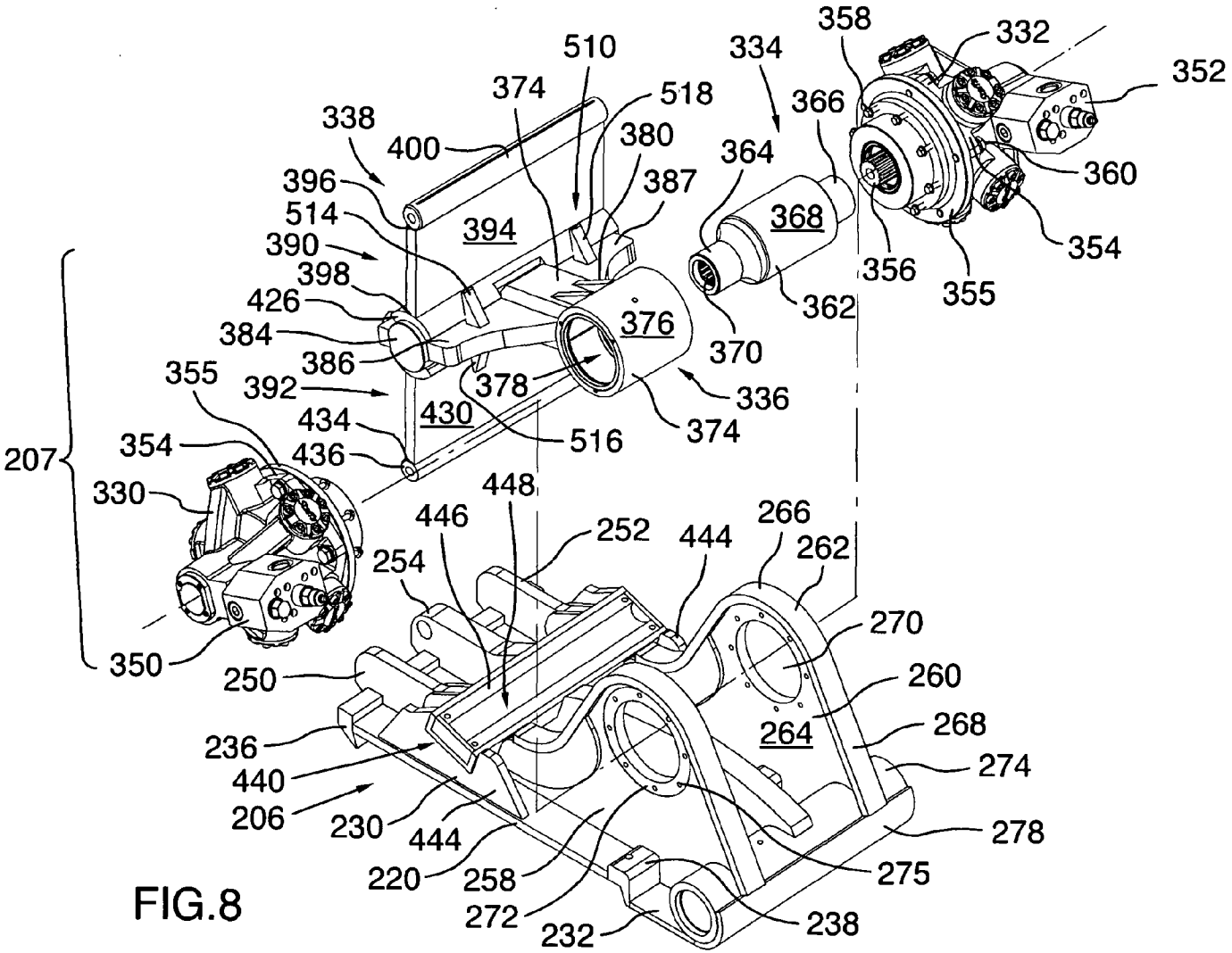
FIG. 8 is an exploded perspective view of the drive assembly shown in FIG. 7.

Referring to FIGS. 7, 8 and 10, the movable upper jaw assembly 180 is disposed in the compartment 110. It includes upper jaw plate 204, a carriage weldment or support 206 which holds the upper jaw plate 204 and a jaw-actuating drive assembly 207 carried on the support for imparting movement to the upper jaw plate 204 and the support 206. The upper jaw plate 204 is fixed on the underside of the support 206. It is generally similar to the lower jaw plate 134 in that it too has an upper face (not shown), a lower face 208 and a generally rectangular footprint (when viewed in top plan view) that is defined by opposed front and rear edges 210 and 212, a first lateral edges 214 and a second lateral edge (not visible). In this case, the lower face 208 of the upper jaw plate 204 has a slightly convex profile and is formed with an alternating arrangement of triangular ridges 216 and grooves 218 which extend between the first and second lateral edges. Each ridge 216 and groove 218 runs from the front edge 210 to the rear edge 212. In like fashion to the lower jaw plate 134, the upper jaw plate 204 is also made of high manganese cast steel.

The support 206 includes a base 220 having a front end 222, a rear end 224, an upper face 226 and a lower face 228. The lower face 228 has a first portion 230 which runs from the rear end 222 to a location approximately three-quarters of the length of the base 220, and a second portion 232 adjacent the front end 222. The first portion 230 is raised (or stepped upwardly) relative to the second portion 232. This step in the lower face 228 defines a station which is sized to receive therein the upper jaw plate 204. Front and rear wedging members 234 and 236 are provided to fixedly retain the upper jaw plate 204 on the lower face 228. The wedging members 234 and 236 are adapted to conformingly engage the generally trapezoidal profile of the upper jaw plate 204. The front wedging member 234 bears against the front edge 210 of the upper jaw plate 204 and is attached to the base 220 by a bracket 238 having a generally L-shaped profile. The bracket 238 is welded to the base 220 and forms the transition from the first portion 230 to the second portion 232. The rear wedging member 236 is welded to the base 220 at the front end 222 thereof and abuts the rear edge 212 of the upper jaw plate 204.

Projecting from the upper face 226 of the base 220 are three, spaced apart, reinforcing rib members—a first lateral rib member 250, a second lateral rib member 252 and a third intermediate lateral rib 254 member disposed between the first and second rib members 250 and 252. Each of the rib members 250, 252 and 254 has a downwardly-oriented notch 256 defined at the rear end thereof. The front wedging member 234 extends laterally along the front end 222 of the base 220 with portions of the wedging member 234 fitting within the notches 256. In this embodiment, the notches 256 serve as connection sites for welding the front wedging member 234 to the ribs 250, 252 and 254.

The rib members 250, 252 and 254 extend along the entire length of the base 220. Midway between the front and rear ends 222, the first and second lateral rib members 250 and 252 transition into upstanding support plates 258 and 260, respectively. When viewed in profile, the support plates 258 and 260 have a roughly hump-like appearance with rounded top portions 262 (as best shown in FIGS. 9 and 10). Each support plate 258, 260 includes a vertically oriented web 264, a first generally S-shaped flange member 266 welded to the upper edge of the web 264 and a second straight flange member 268 welded to the front edge of the web 264. Defined in each web 264 at a location beneath each rounded top portion 262, is a relatively large aperture 270 sized to accommodate therethrough a portion of the drive assembly 207. The aperture 270 is reinforced with a third circular flange member 272 bolted onto the web 264. The flange member 272 has a plurality of bores 275 defined therein.

At the lower rear end of each web 264 a generally circular portion has been trimmed away to make way for the placement therein of a tubular member 274 which runs laterally between the lateral edges of the base 220. The outer surface of the tubular member 274 is welded to each web 264 along the edges 276 defined by the trimmed portion. The lowermost extremity of the tubular member 274 is supported on the second portion 232 of the base 220. A curved plate 278 welded to the outer surface of the tubular member 274 cooperates with the web 264, the second portion 232 of the base 220 and a portion of the second flange member 266 to ensure the tubular member 274 is securely fixed to the support 220. Additionally, the rear end of the intermediate rib member 254 is configured to conform to the arcuate profile of the tubular members and provides an additional welding site for attachment of the tubular member 274.

The tubular member 274 forms part of a hinge or pivot mechanism 280 which pivotally attaches the support 206 to the housing 70 so as to allow movement of the upper jaw assembly 180 between the open jaw setting 176 and the closed jaw position 178 when the rock crusher attachment 20 is actuated. Additionally, the pivot mechanism 280 includes: a solid cylindrical axle 282 having a first end 284 and a second end 286 (visible in FIG. 2); a first bushing assembly 288 associated with the first end 284 of the axle 282; a first locking assembly 290 for fixing the first end 284 of the axle 282 relative to the side panel member 84 of the housing 70; a second bushing assembly (not shown) associated with the second end 286 of the axle 282 and a second locking assembly (not shown) for fixing the second end 286 of the axle 282 relative to the side panel member 86 of the housing 70.

The axle 282 is disposed to extend within the tubular member 274 with its ends 284 and 286 projecting beyond the lateral ends of tubular member 274. The diameter of the axle 282 is sized smaller than the diameter of the tubular member 274 such that a radial gap (not shown) exists between the axle 282 and the tubular member 274 when the axle 282 extends through the tubular member 274. This gap is sized to accommodate the first bushing assembly 288.

Figure 3A:
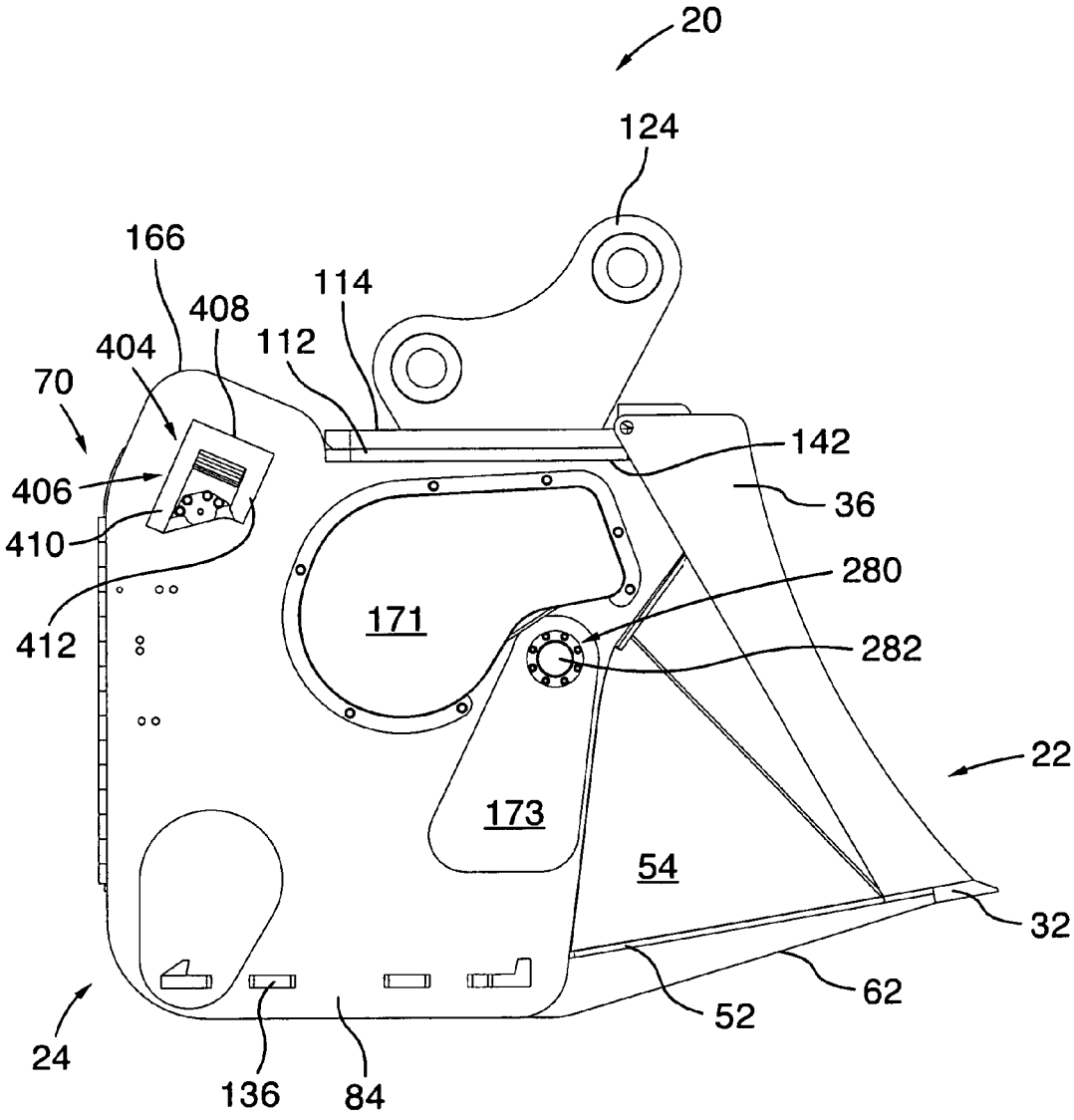
FIG. 3*a* is a left side elevation view of the rock crusher attachment illustrated in FIG. 1.

The first bushing assembly 288 includes an internal sleeve bushing 292 and a resilient annular sealing element or gasket 294. In this embodiment, the sleeve bushing 292 is made of solid brass. In other embodiments, a sleeve bushing made of a different material may be used or alternatively, a different type of bushing altogether could be employed. As shown in FIG. 3*a*, the internal sleeve bushing 292 is disposed a short distance inwardly of the first end 282 of the axle 284. The sealing element is disposed between the sleeve bushing 292 and the first end 282. Its purpose is to keep dust and debris away from the sleeve bushing 292.

The axle 282 is fixed relative to the side panel member 84 and does not move during operation of the rock crusher attachment 20. In this embodiment, the axle 282 functions as a hinge pin with the tubular member 274 serving as a large movable or pivotable hinge knuckle in the pivot mechanism 280. During operation of the rock crusher attachment 20, the tubular member 20 will be urged to rotate about the axle 282 by the drive assembly 207.

With reference to FIG. 3*a*, the first locking assembly 290 includes an external locking ring or collar 300 and an internal locking ring or collar 302 engageable with the external locking collar 300 to apply a wedging force against the axle 282. As will be understood from the description that follows the external and internal locking collars 300 and 302 together define a taper lock bushing.

Figure 3B:
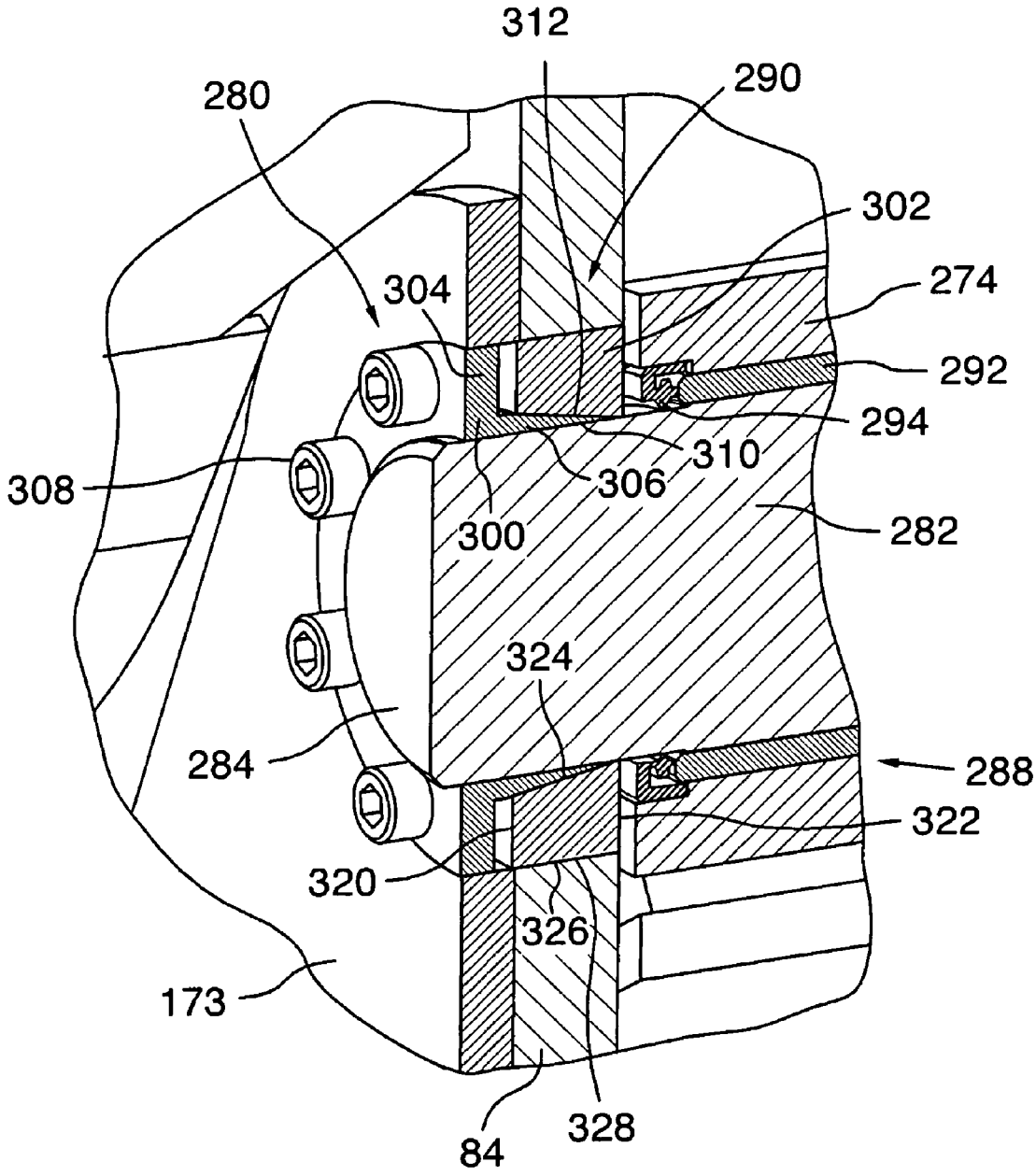
FIG. 3*b* is a front right, perspective, cross-sectional view of rock crusher attachment illustrated in FIG. 3 taken along line "3*a*-3*a*" showing in isolation the axle assembly used to pivotally connect the upper jaw assembly to the housing of the rear crushing portion.

The external locking collar 300 has a flange portion 304 and a sleeve portion 306 joined to, and extending away from, the flange portion 304. The flange portion 304 has a plurality of bores (not visible) defined therein at circumferentially spaced locations. The bores are sized to accommodate fasteners in the nature of bolts 308 therethrough to attach the external locking collar 300 to the internal locking collar 302. As best shown in FIG. 3*b*, the sleeve portion 306 has an outer radial face 310 and an inner radial face 312. The radial faces 310 and 312 cooperate with each other to define a triangular profile for the sleeve portion 306. The inner radial face 312 is disposed generally perpendicular to the external face of the flange portion 304, and bears against the outer surface of the axle 282. The outer radial face 310 converges to the inner radial face 312, in the direction opposite the flange portion 304.

The internal locking collar 304 has a generally trapezoidal profile when viewed in cross-section (see FIG. 3*b*). This trapezoidal profile is defined by an external lateral face 320, an opposed internal lateral face 322, an inner radial face 324 and an outer radial face 326. The lateral faces 320 and 322 are generally parallel to each other. The external lateral face 320 has a plurality of blind threaded bores (not visible) which are alignable with the bores defined in the flange portion 304 of the external locking collar 300 for receiving the bolts 308. The radial faces 324 and 326 are not parallel to each other. The outer radial face 326 is disposed generally perpendicular to both lateral faces 320 and 322, and bears against the circumferential edge 328 of the first side panel member 84. The inner radial face 324 extends in a divergent manner from the external lateral face 320 toward the internal lateral face 322. Thus configured, the inner radial face 324 defines a surface against which the wedging force of the outer radial face 310 of the external locking collar 300 can be applied.

During assembly of the rock crusher attachment 20, the internal locking collar 300 is fitted through the second aperture 170 in the first side panel 84 and over the first end 284 of the axle 282. Thereafter, the external locking collar 300 is fitted on the axle 282. The bores defined in the flange portion 304 of the external locking collar 300 are then aligned with the blind bores formed in the external lateral face 320 of the internal locking collar 302. The bolts 308 are inserted into the aligned bores and secured. As the bolts 308 are tightened, the external locking collar 292 and the internal locking collar 302 are drawn into closer engagement with the outer radial face 310 of the external locking collar 300 now being brought to bear against a greater portion of the inner radial face 324 of the internal locking collar 302. The resulting wedging action generated by the contact between faces 310 and 324 exerts a first force directed radially outward which urges the outer radial face 322 of the internal locking member 302 against the circumferential edge 328 of the first side panel member 84. At the same time, a second force is directed radially inward which urges the inner radial face 312 of the external locking member 300 against the outer surface of the axle 282. The application of these forces tends to ensure that the axle 282 remains fixed to the housing 70.

The second locking assembly and the second bushing assembly are substantially identical to their counterpart assemblies (first locking assembly 288 and first bushing assembly 290) both structurally and functionally, such that the foregoing description of the latter will suffice for the former. Moreover, the installation of the second locking assembly and the engagement of the inner and outer locking collars against the side panel member 86 and the outer surface of the axle 282 at the second end 286, are similar in all material respects to that of the first locking assembly 290 described above.

While in this embodiment the first and second locking assemblies are in the nature of taper-lock bushings, it will be appreciated that in other embodiments, the axle 282 could be fixed relative to the housing 70 using different means.

A description of the drive assembly 207 now follows with reference made to FIGS. 7, 8 and 9. The drive assembly 207 includes a pair of first and second, heavy duty, hydraulic motors 330 and 332, an eccentric 334 operatively coupled to the first and second hydraulic motors 330 and 332 for rotation, a yoke or stroke arm 336 configured for surroundingly engaging the eccentric 334, and a double toggle plate arrangement 338 connected to the stroke arm 336.

In this embodiment, the hydraulic motors 330 and 332 are STAFFA™ fixed displacement motors, model no. HMB 030, manufactured by Kawasaki Motors Corp., U.S.A. These motors are capable of generating up to 1445 lbf ft and speeds of up 450 r/min. With a continuous output of 56 hp. The motors 330 and 332 are supplied with hydraulic fluid via port blocks 350 and 352, respectively. Each motor 330, 332 has a body 354 and a splined drive shaft 356 which extends away from the body 354. The body 354 has formed therein a plurality of bores 358 which are alignable with bores (not visible) defined in a flanged mounting member 355 itself fixed to the third flange member 272. During fabrication, a portion of each motor 330, 332 which includes the drive shaft 356 is introduced into each aperture 270 defined in support plate 258, 260. The drive shafts 356 of the motors 330, 332 are oriented toward each other and coupled to the eccentric 334. Thereafter, fasteners in the nature of bolts 360 are inserted into the aligned bores of the motor body 354 and the flanged mounting member 355 and tightened, thereby securely fixing the motors 330 and 332 to the support 206.

A controller (not shown) located in the cab of the earth-moving vehicle is operatively connected to the motors 330 and 332 to actuate same.

While it is generally preferred that the jaw-actuating drive assembly employ two motors, it should be appreciated that this need not be the case in every application. In other embodiments, a single (more powerful) motor could replace the two motors 330 and 332. Preferably, the motors used in the jaw-actuating drive assembly are hydraulic. However, in other embodiments, other types of motors may be employed, such as pneumatic or electric motors.

Referring to FIG. 8, the eccentric 334 includes an elongate body 362 having a first end 364, an opposed second end 366 and a generally cylindrical cam portion 368 extending between the first and second ends 364 and 366. The cam portion 368 is disposed eccentrically relative to the ends 364 and 366 and is configured to act on or bear against the sleeve portion 372 of the stroke arm 336. In this embodiment, the cam portion 368 has a 1 in. offset relative to the center axis of the elongate body 362. However, in an alternative embodiment, the cam portion could be configured with a greater or lesser offset. Defined at each end 364, 366, is a splined bore sleeve 370 which is configured to matingly engage the splined drive shaft 356 of each motor 330, 332. The ends 364 and 366 of the eccentric 334 are each supported on an annular bearing assembly (not visible) carried in the flanged member 335. When the motors 330 and 332 are actuated, the rotary motion that is generated by the motors is transferred from the motor drive shafts 356 to the eccentric 334 via the bore sleeves 370.

Referring to FIGS. 8 and 10, the stroke arm 336 includes sleeve portion 372 and an arm portion 374 mounted to extend radially outward from the outer radial face 376 of the sleeve portion 372. Defined in the sleeve portion 372 is an opening 378 which is sized to receive therein the cam portion 368 of the eccentric 334. A sleeve bushing (not shown) lines the opening 378 and provides a bearing surface against which the cam portion 368 can engage. The sleeve portion 372 along with the cam portion 368 of the eccentric 334 are disposed between the support plates 258 and 260. As the eccentric 334 rotates, the cam portion 368 bears against the sleeve portion 372 urging it to travel along a generally elliptical path relative to the center axis of the elongate body 362.

The stroke arm 336 is reinforced at the juncture of the sleeve portion 372 and the shaft 374 by an upper pair of spaced apart triangular gusset plates 380 and a lower pair of spaced apart triangular gusset plates 382. The arm portion 374 extends rearward from the juncture to connect to a laterally extending cylindrical shaft 384 which forms part of the double toggle plate arrangement 338. The arm portion 374 is fixedly attached to the shaft 384 approximately at its longitudinal midpoint. To further reinforce the connection, fin-like members 386 and 387 extend laterally from either side of the arm portion 374 for attachment to the shaft 384. More specifically, the shaft 384 is captively retained between the forwardly disposed fin-like members 386 and 387, and the rearwardly disposed locking bar 388 (best shown in FIG. 9). A plurality of fasteners in the nature of bolts 389 extend through aligned bores formed in the locking bar 388, the shaft 384 and the fin-like members 386.

The double toggle plate arrangement 338 includes an upper toggle plate assembly 390, a lower toggle plate assembly 392, shaft 384 disposed between the upper and lower toggle plate assemblies 390 and 392 and a biasing assembly 393 for maintaining the upper and lower toggle plate assemblies 390 and 392 in bearing engagement with the shaft 384. As will be explained in greater detail below, the displacement of the stroke arm 336 (caused by the actuation of the motors 330 and 332 and the camming action of the eccentric 334 on the sleeve portion 372) urges the double toggle plate arrangement 338 into flexion (shown in FIG. 10) or full extension (shown in FIG. 11).

Figure 12A:
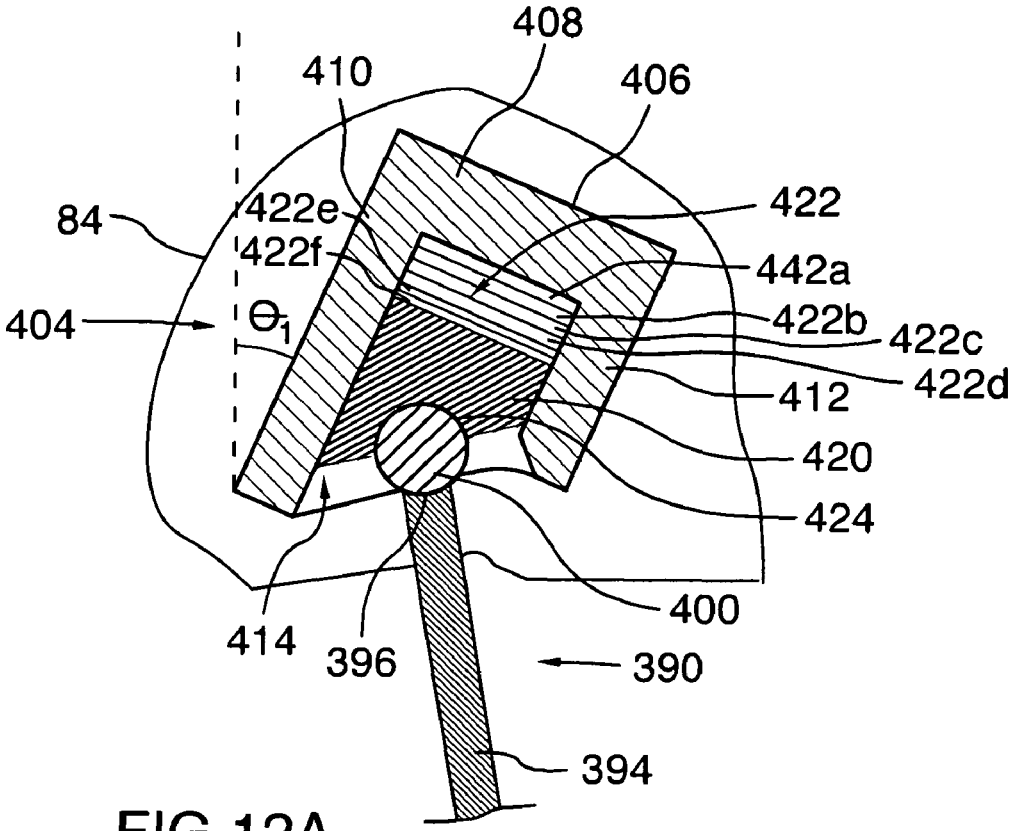
FIG. 12*a* is a view similar to that illustrated in FIG. 10, but magnified to show the first seat member of the double toggle plate arrangement.

Referring to FIGS. 10 and 12*a*, the upper toggle plate assembly 390 has a plate 394 provided with an upper edge 396 and a lower edge 398. Welded to the upper edge 396 along its entire length is a laterally-extending, cylindrical roller member 400. The roller member 400 is received in a first seat member 404 for bearing engagement. The first seat member 404 is disposed in the bulging portion 166 at the rear of the housing 70. It extends laterally between, and is fixed to, the side panel members 84 and 86. Arranged in this manner, the seat member 404 can be seen to define at least partially the top portion of the housing 70.

As best shown in FIG. 12*a*, the first seat member 404 includes a U-shaped channel 406 having its back 408 oriented generally upwardly but at an angle $\theta_1$ and its legs 410 and 412 depending generally downwardly at the same angle $\theta_1$. In this embodiment, the angle of inclination $\theta_1$ of the first seat member 404 is approximately 23 degrees from a vertical axis. In other embodiments, this angle could be varied to suit a particular geometry.

Disposed within the space 414 defined by the channel legs 410 and 412 and back 408 are an upper bearing block 420 and a plurality of planar spacer members or shims 422. The upper bearing block 420 has a generally triangular profile with a substantially semicircular cutout 424. The cutout 424 is configured to conform to the profile of the roller member 400. The roller member 400 is fastened to the upper bearing block 420 by a plate 423 and bolts 421.

The shims 422 are disposed between the upper bearing block 420 and the back 408 of the channel 406. A pair of locator dowels 416 extend into the space 414 through openings (not shown) defined in the back 408 and are ultimately received in bores (not shown) defined in the shims 422. Nuts 418 secure the dowels 416 in place. The locator dowels 416 serve to discourage the shims 422 from becoming displaced during actuation of the crushing assembly 72 and peeping out from the lateral openings 419 defined in the channel 406.

In this embodiment, a total of six shims are employed—shims 422*a*, 422*b*, 422*c*, 422*d*, 422*d*, 422*e* and 422*f*. Shims 422*a* to 422*d* are identical to each other and each measure about 5/16 in. thick. Shims 422*e* and 422*f* are identical to each other but are configured slightly thinner than shims 422*a* to 422*d*. Shims 422*e* and 422*f* have a thickness of about 3/16 in.

It will be appreciated that in other embodiments, a greater or lesser number of shims could be used. The shims could be configured with different thicknesses. Further still, a different combination of relatively thick and relatively thin shims may be used or shims of uniform thickness could be employed. In still other embodiments, the shims could be eliminated altogether.

The size of the discharge opening 175 may be adjusted by adding or removing the shims 422. The addition of shims 422 displaces the double toggle plate arrangement 338 generally downwardly thereby narrowing the discharge opening 175 and reducing the largest size of crushed stone to be produced by the crusher assembly 72. Conversely, removing the shims 422 displaces the double toggle plate arrangement 338 generally upwardly thereby enlarging or widening the discharge opening 175 and increasing the largest size of crushed stone to be produced by the crusher assembly 72.

The addition and removal of the shims 422 (and correspondingly, adjusting the largest size of crushed rock to be produced) can be carried out in a matter of minutes (that is, in under 10 minutes) by one person using basic tools. More specifically, to carry out this procedure, the operator first loosens the nuts 418 secured to the dowel locators 416. Thereafter, the biasing assembly 393 is partially disengaged (as explained below) so that the movable upper jaw assembly 180 may be moved to a desired position to allow the removal or addition of one or more shims. If adding one or more shims, the added shim is inserted into the first seat member 404 and slid into position through the lateral opening 419 defined in the channel 406. One or more shims may be removed in the same manner. Next, the biasing mechanism 393 is partially re-engaged (as described below). The locator dowels 416 are inserted through the openings in the channel 406 and into the bores defined in the shims 422, and secured in place by nuts 418. With the locator dowels 416 firmly in place, the biasing mechanism is fully engaged to ensure the movable upper jaw assembly 180 is back in its open jaw setting. From the foregoing, it will thus be appreciated that the addition/removal of shims in this crusher assembly can be accomplished relatively quickly and easily and is simple enough that it could be carried out in the field, if desired.

In the embodiment shown in FIG. 12*a* in which six shims 422 are employed, the size of the discharge opening 175 (as measured between the upper jaw plate 204 of the upper jaw assembly 180 and the lower jaw plate 134) is 1.25 in. when the upper jaw assembly 180 is in the open jaw setting 176, and 0.625 in. when the upper jaw assembly is in the closed jaw setting 178. In this embodiment, the vertical displacement of the rear end of the upper jaw plate 204 relative to the lower jaw plate 134 is 0.625 in. The average size of the crushed rock exiting the discharge opening 175 is approximately 1 in. Moreover, when all six shims are used, the angle of inclination $\theta_2$ of the upper jaw plate 204 relative to a horizontal plane H extending through the lower jaw plate 134 is 33 degrees (see FIG. 10) when the upper jaw assembly 180 is in the open jaw setting 176, and 34.5 degrees (see FIG. 11) when the upper jaw assembly 180 is in the closed jaw setting 178.

In the case where no shims are used, the size of the discharge opening 175 (as measured between the upper jaw plate 204 of the upper jaw assembly 180 and the lower jaw plate 134) is 3.625 in. when the upper jaw assembly 180 is in the open jaw setting 176, and 3 in. when the upper jaw assembly is in the closed jaw setting 178. The largest size of the crushed rock exiting the discharge opening 175 measures is approximately 4.5 in. Moreover, when no shims are used, the angle of inclination $\theta_2$ of the upper jaw plate 204 relative to a horizontal plane H extending through the lower jaw plate 134 is 28 degrees (see FIG. 10) when the upper jaw assembly 180 is in the open jaw setting 176, and 29.5 degrees (see FIG. 11) when the upper jaw assembly 180 is in the closed jaw setting 178.

In this configuration, the upper jaw assembly 180 pivots 1.5 degrees between the open jaw setting 176 and the closed jaw setting 178 (whether shims are used or not). Advantageously, the provision of shims tends to enhance the versatility of rock crusher attachment 20 in that it allows crushed rock of a variable size to be produced. In this embodiment, the largest size of crushed rock can range between 1 in. and 4.5 in. In other embodiments, this range could be expanded or reduced.

The addition or removal of the shims 422 tends not to affect or alter the geometry of the double toggle plate arrangement 338. The slanted orientation of the first seat member 404 (as viewed in profile) allows the geometry of the double toggle plate arrangement 338 to be preserved throughout the range of displacement (adjustment) of the double toggle plate arrangement 338.

While, for reasons of versatility, it is generally preferred that the crusher assembly 72 be configured so as to have a variable-size/adjustable discharge opening 175, this need not be the case in every application. In other embodiments, an alternate crusher assembly could be configured without such functionality. In such embodiments, the position of the double toggle plate arrangement would be fixed and would not be capable of being displaced or shifted upwardly or downwardly. In such cases, no shims would be used and the upper bearing block would abut the back of the channel of the first seat member directly. Moreover, the first seat member would no longer need to have a slanted orientation—it could be oriented vertically.

Referring back to FIG. 8, an arcuate contact plate 426 is mounted to the plate 394 along its lower edge 398. The arcuate contact plate 426 abuts the upper radial surface of the shaft 384. The radius of curvature of the contact plate 426 corresponds closely to the curvature of the shaft 384 to minimize unwanted rocking and vibration as the stroke arm 336 reciprocates during actuation of the rock crusher attachment 20.

Figure 12B:
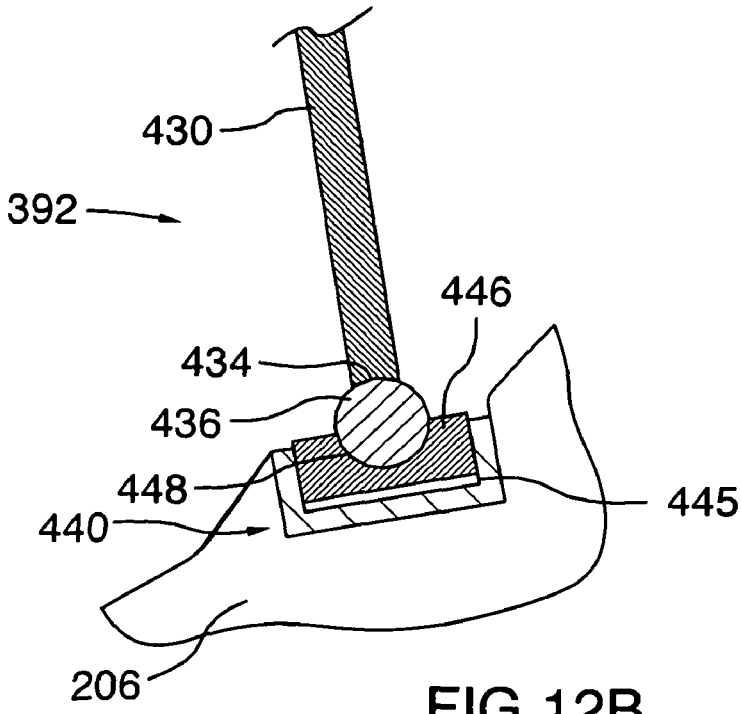
FIG. 12*b* is a view similar to that illustrated in FIG. 10, but magnified to show the second seat member of the double toggle plate arrangement.

Referring to FIGS. 8, 10 and 12*b*, the lower toggle plate assembly 392 is structurally similar to the upper toggle plate assembly 390 in that it too has a plate 430 provided with an upper edge 432 and a lower edge 434. However, in the case of the lower toggle plate assembly 392, an arcuate contact plate 450 similar to contact plate 406 is mounted to the plate 430 along its upper edge 432. The arcuate contact plate 450 abuts the lower radial surface of the shaft 384. The radius of curvature of the contact plate 450 corresponds closely to the curvature of the shaft 384.

A cylindrical roller member 436 is carried on the lower edge 434 and is received within a second seat member 440 for bearing engagement. The second seat member 440 is supported on the carriage 206 and extends transversely of the reinforcement ribs 250, 252 and 254. Additional support is provided at either end of the second seat member 440 by first and second upstanding brackets 442 and 444 (see FIG. 8). The seat member 440 is carried at an angle $\theta_3$ relative to a plane P extending through the support 206. The inclination of the seat member 400 allows the double toggle plate arrangement 338 to maintain proper geometry. In this embodiment, the angle $\theta_3$ measures approximately 28 degrees. In other embodiments, the angle $\theta_3$ could be varied.

The seat member 440 has an open top, box-like configuration. Disposed within the seat member 440 are a bearing plate 445 and a lower bearing block 446 having a generally rectangular profile with a substantially semicircular cutout 448. The cutout 448 is configured to conform to the profile of the roller member 436. The bearing plate 445 is disposed between the seat member 440 and the lower bearing block 446. In this embodiment, the bearing plate 445 is made of steel. But, this need not be the case in every application. In an alternative embodiment, the bearing plate could be fabricated from a compressible/resilient material so as to function as a dampening pad or cushion. This dampening pad would allow the hydraulic motors to come to a controlled, "soft" stop rather than jamming the upper jaw assembly violently, in the event the crusher assembly encounters a non-crushable material.

Figure 11:
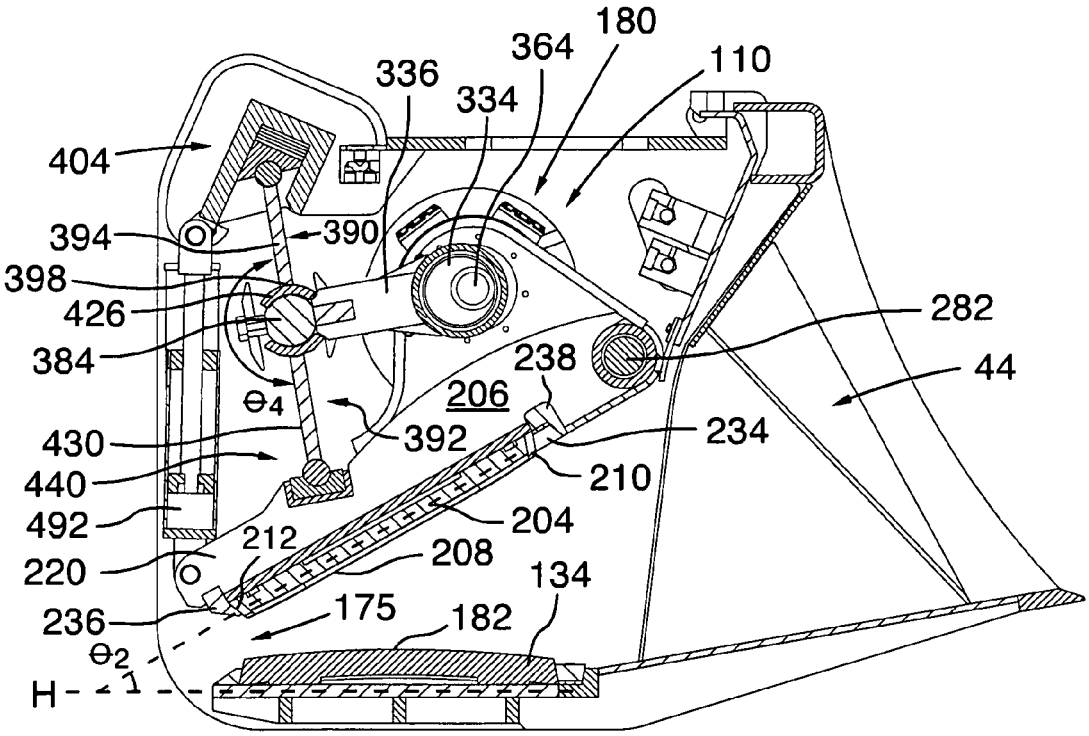
FIG. 11 is a cross-sectional view of the rock crusher attachment similar to that illustrated in FIG. 10 showing the double toggle plate arrangement of the drive assembly fully straightened.

Referring back to FIG. 10, when the double toggle plate arrangement 338 is in flexion, the upper toggle plate 394 has a skewed orientation relative to the lower toggle plate 430. The upper toggle plate 394 is radially displaced from the lower toggle plate 430 by an angle $\theta_4$. In this embodiment, the angle $\theta_4$ measures 152 degrees. When the double toggle plate arrangement 338 is fully extended as shown in FIG. 11, the upper toggle plate 394 is in planar alignment with the lower toggle plate 430 such that the angle $\theta_4$ measures 180 degrees.

While it is generally preferred that the double toggle plate arrangement 338 be on center (i.e. the upper and lower toggle plates are in planar alignment with each other) at the end of its stroke such that a single crushing action is delivered per rotation of the eccentric 334, this need not be the case in every application. In other embodiments, the geometry of the double toggle plate arrangement and the stroke arm could be configured so that the double toggle plate arrangement travels over center at the end of its stroke. This could be achieved, for instance, by using a longer stroke arm or by extending the length of the stroke arm with the addition of removable spacers mounted between the stroke arm and the shaft of the double toggle plate arrangement. By having the double toggle plate arrangement move over center, the crusher assembly would be configured to perform two crushing movements per rotation of the eccentric.

Figure 5:
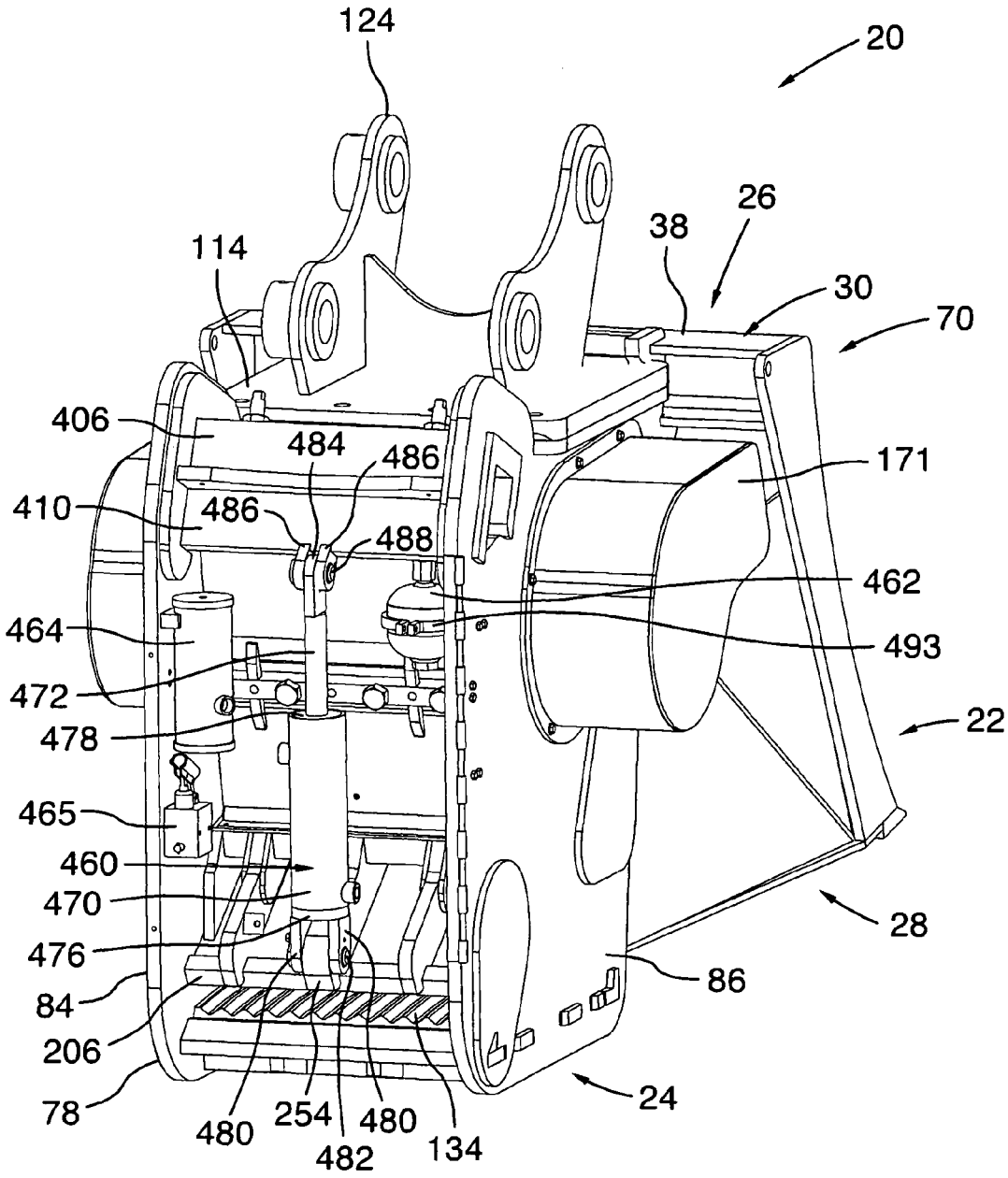
FIG. 5 is a rear end view of the rock crusher attachment illustrated in FIG. 1 with the rear panel of the crusher portion housing removed to reveal internal details thereof.

FIG. 5 shows the biasing assembly 393 disposed at the rear of the housing 70 behind the upper and lower toggle plate assemblies 390 and 392. The biasing assembly 393 includes a hydraulic cylinder 460, an accumulator 462 in fluid communication with the hydraulic cylinder 460, a cylindrical tank or reservoir 464 for storing hydraulic fluid and a hand actuated pump 465 operable to charge the accumulator 462 with hydraulic fluid from the reservoir 464. Hydraulic feed lines connect the accumulator 462 to the hydraulic cylinder 460 and to the pump 465. Similarly, the reservoir 464 is also connected to the pump 465 by another feed line. None of these feed lines are shown in FIG. 5, these having been omitted for the sake of clarity.

The hydraulic cylinder 460 is mounted to extend between the channel 406 of the first seat member 404 and the support 206 of the upper jaw assembly 180. The cylinder 460 has a cylindrical body 470, a piston rod 472 mounted to extend within the body 470 and a piston 474 accommodated within the body 470 and connected to the piston rod 472. The bottom of the body 470 is closed off by a lower end cap 476, while the top thereof is closed off by an upper end cap 478. Extending generally perpendicularly from the lower end cap 476 is a pair of spaced apart prongs or arms 480. The arms 480 have apertures (not shown) defined adjacent their distal ends. These apertures are alignable with a bore (not shown) defined in the third intermediate rib member 254 of the support 206 to allow a bolt or locking pin 482 to be inserted therethrough. It will thus be appreciated that in this arrangement, the lower end cap 476 and its depending arms 480 define a clevis, with the locking pin 482 serving as a clevis pin and the intermediate rib member 254 serving as a tang. This clevis fastening arrangement is used to pivotally connect the bottom of the hydraulic cylinder to the support 206.

The piston rod 472 extends through the upper end cap 478 and has a first end 484 pivotally connected to the leg 410 of the channel 406. More specifically, the first end 484 is pivotally retained between two mounting tabs 486 depending downwardly from the leg 410. The mounting tabs 486 have openings (not shown) formed therein which are alignable with a bore (not shown) defined in the first end 484 of the piston rod 472 to allow a bolt or locking pin 488 to be inserted therethrough. The leg 410 and mounting tabs 486, the first end 484 of the piston rod 472 and the locking pin 488 all cooperate with each other to define another clevis fastening arrangement.

The piston 474 is carried on the second end 490 of the piston rod 472 opposite the first end 484 and is provided with sealing elements for sealing engagement with the inner surface of the body 470. The piston 474 cooperates with the inner surface of the body 470 and the lower end cap 474 to define a first piston-side chamber 492 filled with air. Opposite the first chamber 492 is a second rod-side chamber 494 defined by the piston 474, the inner surface of the body 470 and the upper end cap 478. The second chamber 494 holds hydraulic fluid and is connected to the accumulator 462 via a feed line.

The accumulator 462 is carried on the inner lateral face 493 of the side panel member 84 by a bracket 495. In this embodiment, the accumulator 462 is a hydro-pneumatic, bladder-type accumulator 462 with hydraulic fluid stored in a reservoir held under pressure of compressed gas. From time to time, the pump 465 may be actuated to urge the flow of hydraulic fluid into the accumulator reservoir.

The biasing assembly 393 works to maintain the double toggle plate arrangement 338 in flexion and the upper jaw assembly 180 in the open jaw setting 176. In so doing, it tends to encourage constant bearing engagement between the shaft 384 and the contact plates 426 and 450 and tends to prevent the shaft 384 from being dislocated from its position between the upper and lower toggle plates 390 and 392. When the double toggle plate arrangement 338 is in flexion, the force applied to the hydraulic fluid by the accumulator 462 maintains the hydraulic cylinder 460 in its retracted position 500 with the second rod-side chamber 494 occupying is largest volume. When the double toggle plate arrangement 338 is urged to fully extend, the hydraulic cylinder 460 is urged to move to its extended position 502. The force applied by the piston 472 against the hydraulic fluid in the second rod-side chamber 494 overcomes the pressure from the accumulator 462 thereby causing some of the hydraulic fluid in the second chamber 494 to flow into the accumulator 462.

To disengage the biasing assembly 393, the air pressure in the accummulator 462 is lessened by depressurizing the pump 465. This can be accomplished using the handle of a jack or other tool. Lessening of the air pressure in the accumulator 462 causes hydraulic fluid in the second rod-side chamber 494 to be drawn up into the accumulator reservoir. This in turn causes the hydraulic cylinder 460 to move to its extended position 502. When the biasing assembly 393 is being disengaged to add or remove shims 422, the extension of the piston rod 472 will cause the upper plate assembly 390 (and the roller member 400) to become spaced from the first seat member 404.

To engage the biasing assembly 393, the pump 465 will be used to build the pressure of the compressed gas in the accumulator. The pressurized compressed gas will bear against the accumulator reservoir holding hydraulic fluid and will urge some of that hydraulic fluid to flow into the second rod-side chamber 494 of the hydraulic piston 460. This in turn will cause the hydraulic cylinder 460 to move to its retracted position 500, the movable upper jaw assembly 180 to be further spaced from the lower jaw plate 134 and the double toggle plate arrangement 338 more firmly held in position between the carriage 206 and the first seat member 404.

As may be appreciated by a person skilled in the art, the biasing assembly 393 shown in FIG. 5 offers certain advantages over known jaw biasing systems, such as those employing mechanical springs. The biasing assembly 393 tends to be lighter than conventional spring-based biasing systems and less prone to breakage. Moreover, adjustments to the jaw return pressure can be achieved on the field easier and more rapidly with the biasing assembly 393 than with the conventional spring-based biasing systems.

The double toggle plate arrangement 338 is further provided with additional safety means to discourage dislocation of the shaft 384 from between the upper and lower toggle plates 390 and 392, in the nature of front and rear guard means 510 and 512. In this embodiment, the front guard means 510 takes the form of a first pair of upper and lower guard members 514 and 516 and a second pair of upper and lower guard members 518 (the lower guard is not visible in the drawings). The upper guard member 514 extends upwardly from and is welded to the upper face of the fin-like member 386, while the upper guard member 518 is extends upwardly from and is welded to the upper face of the fin-like member 387. The lower guard member 516 of the first pair is disposed directly opposite the upper guard member 514. It extends downwardly from and is welded to the lower face of the fin-like member 386. Similarly, the lower guard member of the second pair is disposed directly opposite the upper guard member 518. It extends downwardly from and is welded to the lower face of the fin-like member 387.

The rear guard means 512 is disposed opposite the front guard means 510. In like fashion to the front guard means 510, the rear guard means 512 includes a first pair of upper and lower guard members 520 and 522 and a second pair of upper and lower guard members 524 and 526 (see FIG. 9). The upper guard members 520 and 524 extend upwardly from and are welded to the upper face of the locking bar 388. The lower guard members 522 and 526 are disposed directly opposite the upper guard members 520 and 524, respectively. Each lower guard member 522, 526 extends downwardly from and is welded to the lower face of the locking bar 388.

It will be appreciated that in other embodiments, the means for discouraging dislocation of the shaft from between the upper and lower toggle plates could be configured differently. For instance, instead of having a pair of upper guard members for each of the front and rear guard means, it may be possible to merge the pair of upper guard members into a single guard member—one for each front and rear guard means. The same could be done for the pairs of lower guard members for the front and rear guard means. Other changes are, of course, possible.

Operation of the rock crusher attachment 20 (and in particular, the crusher assembly 72) is now described in greater detail. The operator of the earthmoving vehicle lowers the boom carrying the rock crusher attachment 20 and orients the bucket portion 22 toward a pile of rocks to be crushed 46. The rocks 46 are scooped into the bucket body 28 and make their way through the chute 60 toward the crusher assembly 72 (see FIG. 13*a*). To facilitate the passage of the rocks 46 through the chute 46, the bucket portion 22 could be oriented upward so that rocks 46 can make their way through the chute 60 and toward the crushing portion 24, assisted by gravity.

The motors 330 and 332 of the drive assembly 74 are energized to thereby generate rotary motion. This rotary motion is transmitted through the drive shafts 356 to the eccentric 334 whereat it causes the cam portion 368 to bear against the sleeve portion 372 of the stroke arm 336. The application of the camming force on the sleeve portion 372 causes it (and the stroke arm 336) to travel along a generally elliptical path relative to the center axis of the elongate body 362. As stroke arm 336 travels rearward, the biasing force of the biasing assembly 393 is overcome causing the hydraulic cylinder 460 to be moved to its extended position 502. The double toggle plate arrangement 338 is urged from its position of flexion to being fully extended and the upper jaw assembly 180 is urged to pivot about the axle 282 toward the lower jaw plate 134. As this occurs, the gap between the upper and lower jaw plates 204 and 134 at the rear of the crusher assembly 72 narrows and a crushing force is applied to the rocks 46 (see FIG. 13*b*). The rocks 46 fracture into smaller rock fragments and exit the crusher assembly 72 through the discharge opening 175.

It should be appreciated that by virtue of the drive assembly 207 (including motors 330 and 332) being carried on the support 206 and thus moving with the upper jaw assembly 180 between open and closed jaw settings 176 and 178 when the crusher assembly 72 is actuated, a fast-acting, very powerful and relatively compact crushing mechanism is created. In this embodiment, the motors 330 and 332 are run at 350 RPM when the crusher assembly 72 is actuated, such that the crushing action is repeated 350 times per minute, thereby allowing the rock crusher attachment 20 to crush relatively large volumes of rock in a very short period of time. In other embodiments, the motors may be run at different speeds.

In this embodiment, the rock crusher attachment 20 is capable of crushing in the range of 25 to 85 tons per hour depending on the desired size of the crushed product, the number of shims 422 used and the hardness of the rock to be crushed. Generally speaking, the crushing volumes at the higher end of the range may be obtained in circumstances where the double toggle plate arrangement 338 does not make use of any shims 422 and where softer rock is being crushed. The volumes of rock that the rock crusher attachment 20 is capable of handling tend to be in the same range as those handled by much larger conventional rock crushers.

Referring to FIGS. 14 to 17, there is shown a twin rock crusher attachment in accordance with another embodiment of the present invention. The twin rock crusher attachment, designated generally in the drawings with reference numeral 560, includes a front bucket portion 562 and two rear crusher portions—a first lateral crusher portion 564 and a second lateral crusher portion 566—joined thereto. The front bucket portion 562 is provided with a frame 568 welded to a bucket body 570. The frame 568 includes a top frame assembly 572, an opposed bottom blade-like lip member 574 and a pair of spaced apart, vertically extending, elongate side frame members 576 and 578 which join the top frame assembly 572 to the bottom lip member 574.

In this embodiment, the top frame assembly 572 includes a first top frame member 580, a second top frame member 582 and a third top frame member 584 placed side-by-side and welded to each other, with the third top frame member 584 disposed between the first and second top frame members 580 and 582. Each top frame member 580, 582, 584 is in the nature of a C-shaped structural member 586 (not unlike C-shaped structural member 38) with its back oriented frontward and its arms extending rearward.

The bucket body 570 is defined by a top panel 590; a bottom panel assembly 592; a pair of spaced apart, inwardly and rearwardly extending, outer side panel portions 594 and 596; a pair of spaced apart, outwardly and rearwardly extending, inner side panel portions 598 and 600; and a wedge-like or V-shaped blade 602. The side panel portions 594, 596, 598 and 600, and the V-shaped blade 602 extend between and join the top panel 590 to the bottom panel assembly 592.

The bottom panel assembly 592 includes a first bottom panel portion 604, a second bottom panel portion 606 and a third bottom panel portion 608 placed side-by-side and welded to each other. The third panel portion 608 is disposed between the first and second panel portions 604 and 606.

The uppermost margin of the top panel 590 is welded to the lowermost margin of the top frame assembly 572. Portions of the side edges of the top panel 590 are also welded to the side frame members 576 and 578. The side panel portion 594 is attached along its front edge to the side frame member 576 and has its upper and lower edges welded to the top panel 590 and first bottom panel portion 604, respectively. Similarly, the side panel portion 596 is attached along its front edge to the side frame member 578 and has its upper and lower edges welded to the top panel 590 and second bottom panel portion 606, respectively.

Each side panel portion 598, 600 is arranged so as to diverge or splay outwardly from its counterpart side panel portion 594, 596, respectively. The upper edge of the side panel portion 598 is welded to the top panel 590, while its lower edge is welded to first bottom panel portion 604. Similarly, the upper edge of the side panel portion 600 is welded to the top panel 590, while its lower edge is welded to second bottom panel portion 606. The side panel portions 598 and 600 are connected to each other by the forward facing, V-shaped blade 602. The V-shaped blade 602 is welded in place to the top panel 590 and the third bottom panel portion 608. Lastly, the bottom panel assembly 592 is welded to the bottom lip member 574 along its front edge.

Figure 16:
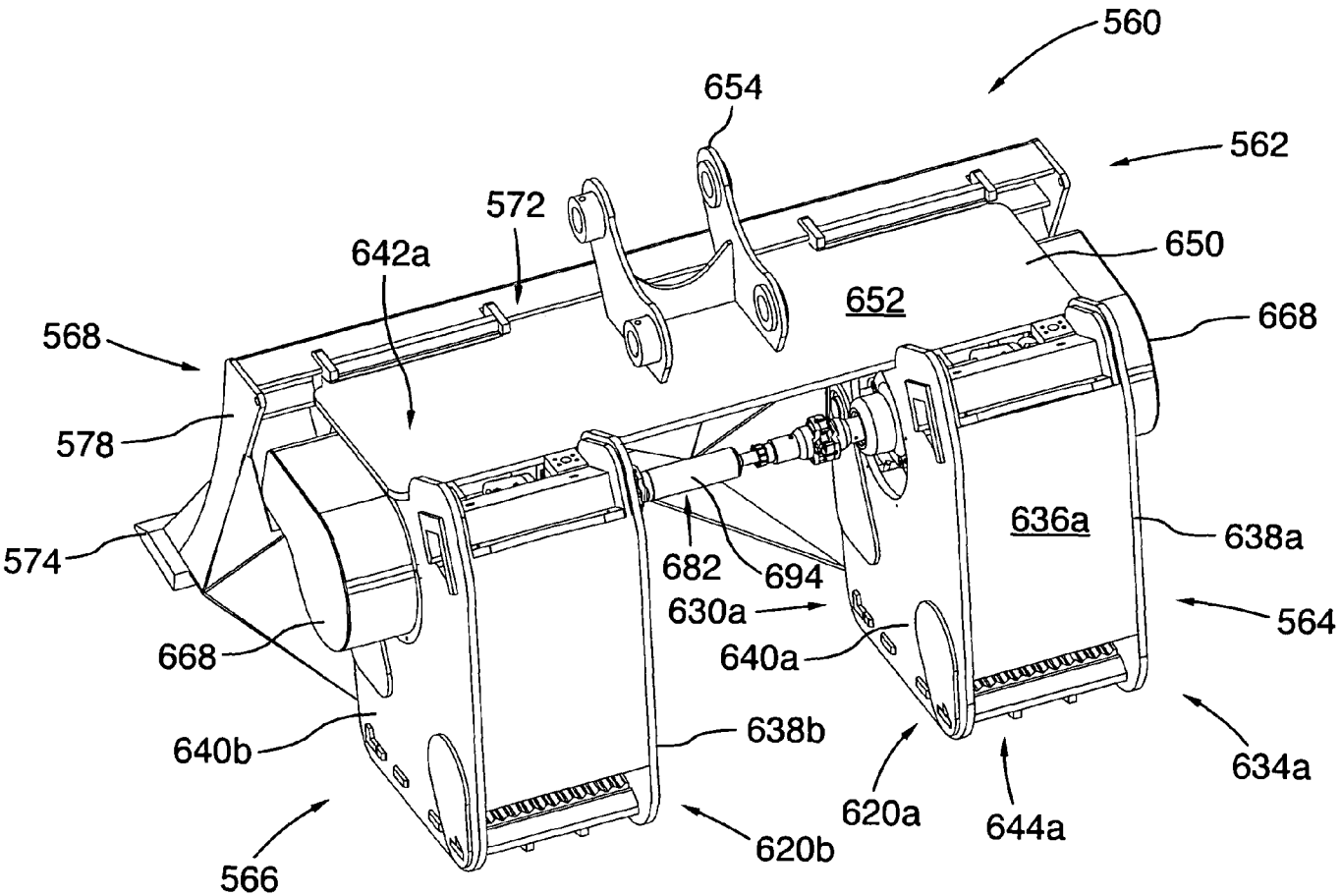
FIG. 16 is a rear end elevation view of the twin rock crusher attachment shown in FIG. 14.

Arranged in this manner, the top panel 590, the first bottom panel portion 604 and the side panel portions 594 and 598 form a first chute 610 within the bucket body 570. In like fashion, a second chute 612 is formed in the bucket body 570 by the top panel 590, the first second bottom panel portion 606 and the side panel portions 596 and 600. When the bucket portion 562 scoops rocks to be crushed from a pile of rocks, the V-shaped blade 602 directs the rocks toward the first and second chutes 610 and 612. As best shown in FIG. 16, the first and second chutes 610 and 612 each taper in the rearward direction, and ultimately open onto the first and second rear lateral crusher portions 564 and 566, respectively. To encourage travel of the rocks 46 toward the rear crusher portions 564 and 566, both the top panel 590 and the bottom panel assembly 592 are downwardly sloping.

Three reinforcement ribs 614 are welded to the outer faces of the first and second bottom panel portions 604 and 606. The ribs 614 extend from the front edge of the bottom panel portions 604 and 606 and project beyond the rear edge 64 thereof for attachment to the first and second rear crusher portions 564 and 566.

The rear lateral crusher portion 564 and 566 are spaced apart from each other—each one is disposed at opposite ends of the bucket body 570. Each rear lateral crusher portion 564, 566 is generally similar to the rear crusher portion shown in FIG. 1 in that each crusher portion 564, 566 has a housing 620*a*, 620*b* which accommodates a jaw-type crusher assembly 622*a*, 622*b*, respectively. For the sake of convenience in the description that follows, a reference numeral followed by the suffix "a" is indicative of a component of the first crusher portion 564, while a reference numeral followed by the suffix "b" is indicative of a component of the second crusher portion 566.

Both housings 620*a* and 620*b* have structures similar to that of housing 70, such that it will suffice to describe only one housing—housing 620*a*. Housing 620*a* has a front end 630*a* and rear end 634*a*, and further includes a front protective face plate (not visible), an opposed rear protective face plate 636*a*, two spaced apart, first and second side panel members 638*a* and 640*a*, a top panel assembly (not visible) and a bottom panel assembly 644*a*. The front and rear face plates 636*a*, and each of the top assembly and the bottom assembly 644*a* extend between and the first side panel member 638*a* and the second side panel member 640*a* to connect one to the other. As with housing 70, each housing 620*a*, 620*b* has a compartment (not visible, but similar to compartment 110) which accommodates a portion of the crusher assembly 622*a*, 622*b*.

The structure, configuration and assembly of each of the front and rear face plates 636*a* and the bottom panel assembly 644*a* are substantially identical to their counterpart components in housing 70, such that no additional description is required.

The top panel assembly 642*a* includes a first steel plate (not visible) which is welded to the top edges of the first and second side panel members 638*a* and 640*a*. A relatively long, second plate 650 spans between the housings 622*a* and 622*b* and is fastened onto the first steel plates of each top panel assembly 642*a*, 642*b*. Welded to the top face 652 of the second plate 650 at a location between housings 622*a* and 622*b*, is a pair of quick attachment fittings or lugs 654. This arrangement of the second plate 650 and the quick attachments 654 fittings serves to connect the twin rock crusher attachment 560 to the boom of an excavator.

The first and second side panel members 638*a* and 640*a* are identical to each other and to the first and second side panel members 84 and 86 in all material respects, except that only side panel member 638*a* is provided with a protective enclosure 668 (generally resembling protective enclosure 171 shown in FIG. 1). Side panel member 640*a* is not provided with a protective enclosure 668. However, in the case of housing 620*b*, it is side panel member 640*b* that has a protective enclosure 668, while side panel member 638*b* does not have a protective enclosure 668.

Figure 18:
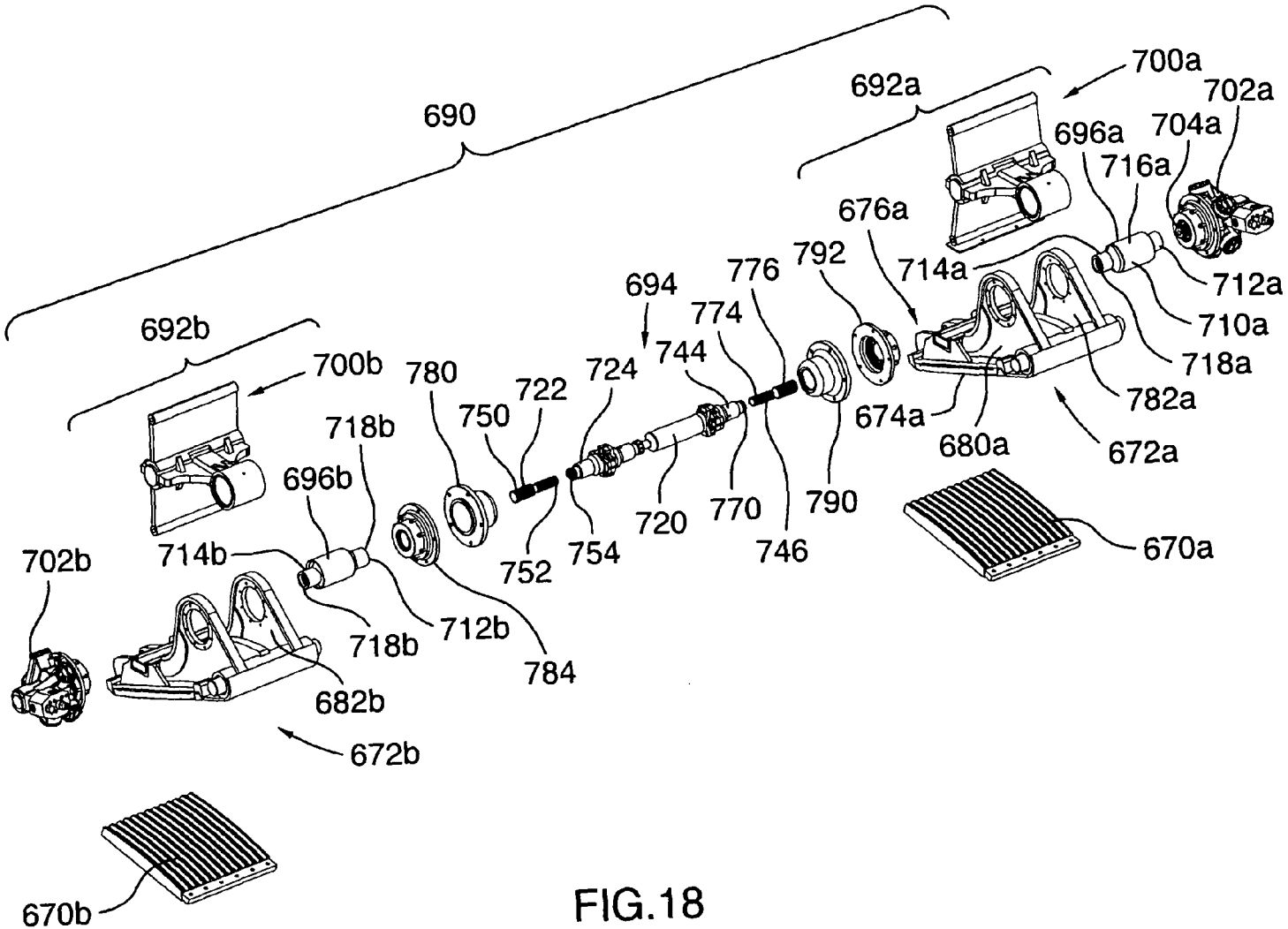
FIG. 18 is an isolated, perspective view of the twin rock crusher attachment illustrated in FIG. 14, with the bucket portion and the housings of each of the rear crushing portions removed to reveal the crusher assemblies, and the movable upper jaw assemblies of the crusher assemblies shown exploded from the rotary motion transmission device.

Turning now to FIG. 18, there can be seen the crusher assemblies 622*a* and 622*b*. The crusher assemblies 622*a* and 622*b* are generally similar to each other and to the crusher assembly 72 shown in FIG. 7, such that only a cursory description of crusher assembly 622*a* will suffice for both assemblies 622*a* and 622*b*. The crusher assembly 622*a* includes a fixed lower jaw plate 670*a* (similar to lower jaw plate 134) and a movable upper jaw assembly 672*a* (generally similar to movable jaw plate 180) mounted opposite (and spaced apart from) the lower jaw plate 670*a*. The movable upper jaw assembly 672*a* is pivotally connected to the housing 620*a* at its front end and can be urged to move between an open jaw setting and a closed jaw setting. The movable jaw assembly 672*b* is mounted similarly to the housing 620*b*.

Much like the movable upper jaw assembly 180, the movable upper jaw assembly 672*a* includes an upper jaw plate 674*a* and a carriage weldment or support 676*a* which holds the upper jaw plate 674*a*. The support 676*a* is generally similar to support 206 and is configured with a base 678*a* and a pair of upstanding support plates 680*a* and 682*a*.

However, instead of the movable upper jaw assembly 672*a* having its own jaw-actuating drive assembly similar to jaw-actuating drive assembly 207, it shares a common jaw-actuating drive assembly 690 with the movable upper jaw assembly 672*b*. The jaw-actuating assembly 690 includes a first drive subassembly 692*a* associated with the first crusher assembly 622*a*, a second drive subassembly 692*b* associated with the second crusher assembly 622*b* and a mechanism or device 694 for transmitting rotary motion between the first drive subassembly 692*a* and the second drive subassembly 692*b*.

The drive subassemblies 692*a* and 692*b* are mirror images one of the other such that the description of a single drive subassembly—first drive subassembly 692*a*—will suffice. The first drive subassembly 692*a* is generally similar to the drive assembly 207 in that it too includes an eccentric 696*a*, a yoke or stroke arm 698*a* configured for surroundingly engaging the eccentric 696*a* and a double toggle plate arrangement 700*a* connected to the stroke arm 698*a*. However, in contrast to the drive assembly 207 which has two hydraulic motors, the first drive subassembly 692*a* is provided with only a single heavy duty, hydraulic motor 702*a* (generally similar to motors 330 and 332 described above). The hydraulic motor 702*a* is connected to the support plate 680*a* of the carriage 676*a* in much the same way as hydraulic motor 330 is connected to the support plate 258. The hydraulic motor 702*b* is similarly connected to the support plate 682*b* of the carriage 676*b*. In each case, the splined drive shafts 704*a* and 704*b* of the hydraulic motors 702*a* and 702*b* are oriented toward each other and coupled to their respective eccentrics 696*a* and 696*b*.

Referring to FIG. 18, the eccentric 696*a* resembles eccentric 334 in all material respects. It includes an elongate body 710*a* having a first end 712*a*, an opposed second end 714*a* and a generally cylindrical cam portion 716*a* extending between the first and second ends 712*a* and 712*b*. Defined at each end 712*a*, 714*a*, is a splined bore sleeve 718*a*. The sleeve 718*a* at the first end 712*a* is configured to matingly engage the splined drive shaft 704*a* of the motor 702*a*, while the sleeve 718*a* at the second end 714*a* is adapted to receive a portion of the rotary motion transmission device 694. In the case of eccentric 696*b*, the sleeve 718*b* at the first end 712*b* is configured to receive a portion of the rotary motion transmission device 694 and the sleeve 718*b* provided at the opposite end 714*b* is adapted for mating engagement with splined drive shaft 704*b* of the motor 702*b*. When the motors 702*a* and 702*b* are actuated, the rotary motion that is generated by the motors is transferred from the motor drive shafts 704*a* and 704*b* to the eccentric 696*a* and 696*b* and through the rotary motion transmission device 694.

The ends 712*a* and 714*a* of eccentric 696*a* are each supported on an annular bearing assembly (not visible) disposed in the relatively large aperture formed in the support plate 680*a* and 682*b*. A similar arrangement is provided for eccentric 696*b*.

As best shown in FIG. 18, the eccentrics 696*a* and 696*b* are arranged rotationally out-of-phase relative to each other by 180 degrees. As will be explained in greater detail below, this allows the twin rock crusher attachment to make efficient use of only two motors 702*a* and 702*b* to drive the two crusher assemblies 622*a* and 622*b*, instead of having two motors for each crusher assembly 622*a*, 622*b* as is the case with crusher assembly 72 described above.

The stroke arm 698*a* and the double toggle plate arrangement 700*a* are similar in all material respects (e.g. structure and functionality) to the stroke arm 336 and the double toggle plate arrangement 338, respectively, such that no further description is required. Each crusher assembly 622*a*, 622*b* is also provided with a biasing mechanism (not visible) similar to the biasing mechanism 393 described earlier.

Figure 17:
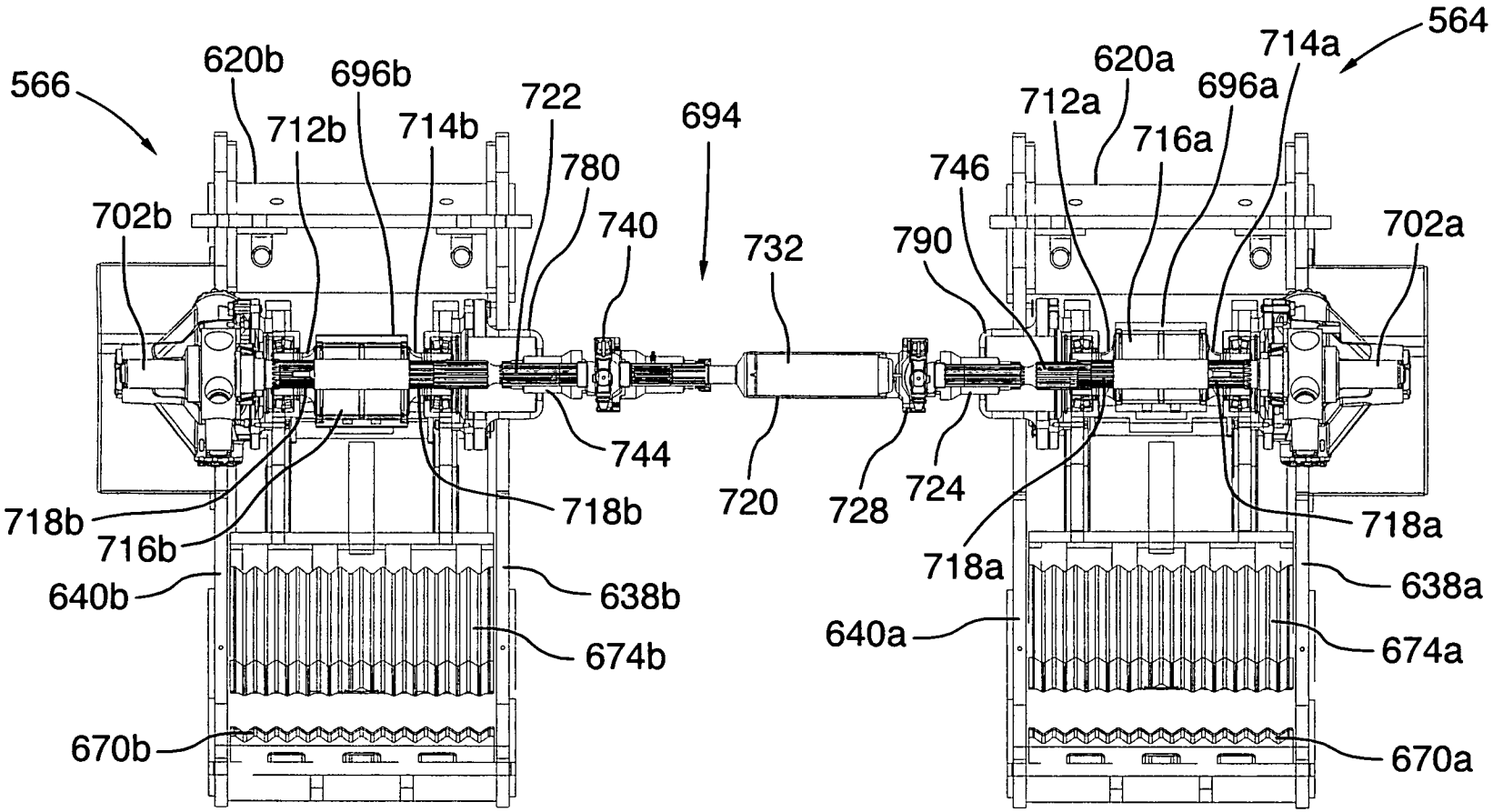
FIG. 17 is a cross-sectional view of the twin rock crusher attachment shown in FIG. 14 taken along line "17-17"
Figure 19:
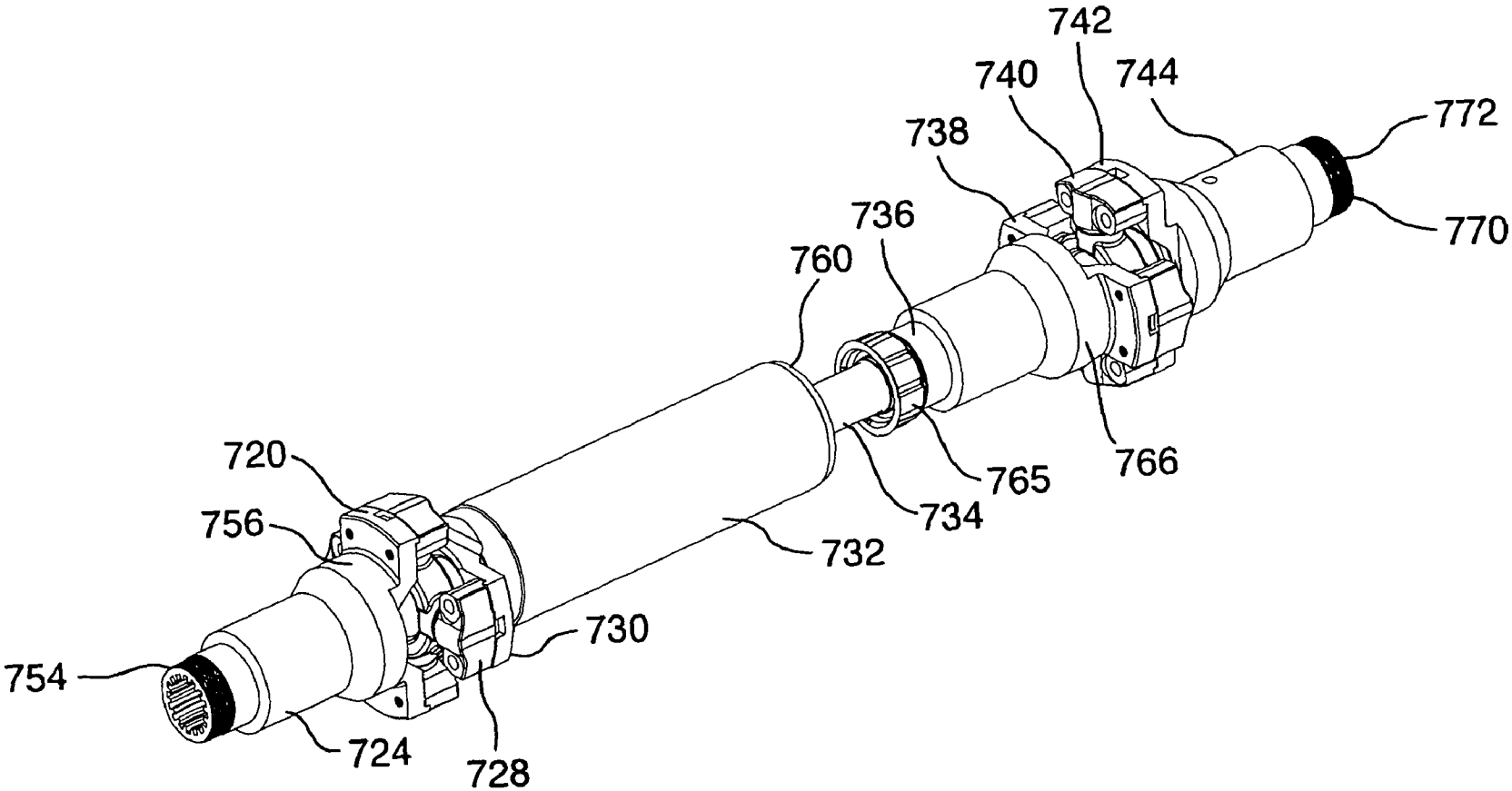
FIG. 19 is an isolated, front elevation view of the rotary motion transmission device shown in FIG. 18.

Referring now to FIGS. 17, 18 and 19, in this embodiment, the rotary motion transmission mechanism 694 takes the form of a universal joint assembly 720. Moving from one end of the joint assembly 720 to the other, the joint assembly 720 can be seen to include: a first splined shaft 722, a first slip yoke 724, a first weld yoke 726, a first wing bearing 728, a second weld yoke 730, a drive line tube 732, a slip stub 734, a second slip yoke 736, a third weld yoke 738, a second wing bearing 740, a fourth weld yoke 742, a third slip yoke 744 and a second splined shaft 746.

The first splined shaft 722 has a first end 750 and an opposed second end 752. The first end 750 of the first splined shaft 722 is configured for mating engagement with the splined bore sleeve 718*b* provided at the first end 714*b* of the eccentric 696*b*. The second end 752 of the first splined shaft 722 is adapted to matingly engage the splined sleeve portion 754 provided at the distal end of the first slip yoke 724. The use of a slip yoke accommodates some axial displacement of the first splined shaft 752 relative to the sleeve portion 754.

The proximal end 756 of the first slip yoke 724 is joined to the first weld yoke 726. Captively retained between the first weld yoke 726 and the second weld yoke 730 is the first wing bearing 728. The bearing 728 imparts two degrees of freedom (rotations) to each of the weld yokes 726 and 730. The drive line tube 732 is mounted to, and extends between, the second weld yoke 730 and the slip stub 734. The slip stub 734 has at one end a conical base portion 760 which is fixed to the drive line tube 732, and at the opposite end, a splined shaft portion (not visible). The splined shaft portion is configured for mating engagement with a correspondingly splined sleeve portion 762 provided at the end 764 of the second slip yoke 736. The engagement of the slip stub 734 with the sleeve portion 762 allows some axial displacement of the splined shaft portion relative to the sleeve portion 762. To prevent or discourage dust or debris from penetrating the sleeve portion 762, a dust seal or collar 765 is threadingly attached to the sleeve portion 762. The body of the collar 765 extends toward the splined shaft portion of the slip stub 734.

In like fashion to the first slip yoke 724, the second slip yoke 734 has fixed at its end 766 (opposite end 764) a third weld yoke 738. The third weld yoke 738 cooperates with the fourth weld yoke 742 to captively retain the second wing bearing 740. The bearing 740 provides two degrees of freedom (rotations) to each of the weld yokes 738 and 742.

Attached to the fourth weld yoke 742 is the third slip yoke 744. Similar to the first slip yoke 724, the third slip yoke 744 has a splined sleeve portion 770 at its distal end 772. The sleeve portion 770 is configured to receive the end 774 of the second splined shaft 746. The use of slip yoke accommodates some axial displacement of the second splined shaft 746 relative to the sleeve portion 770. The end 776 (opposite end 774) of the second splined shaft 746 is configured to matingly engage the splined bore sleeve 718*b* provided at the first end 712*b* of the eccentric 696*b*.

Where the first splined shaft 722 extends into the housing 620*b* to connect to the eccentric 696*b*, there is provided a first protective sleeve member 780 for preventing dust and debris from entering into the drive subassembly 692*b*. The protective sleeve member 780 has a generally tubular body 782 with a mounting flange 784. The mounting flange 784 has bores (not shown) defined therein which are alignable with bores (not shown) formed in a flanged mounting member 786*b* itself attached to the support plate 682*b*. The sleeve member 780 is oriented such that its body 782 extends outwardly through the aperture formed side panel member 640*b*.

A second protective sleeve member 790 resembling sleeve member 780 in structure and configuration is mounted in a similar fashion to the support plate 680*a* with a mounting flange 792, with the second splined shaft 746 extending into the housing 620*a* to connect to the eccentric 696*a*.

Operation of the twin rock crusher attachment 560 is in many ways similar to operation of the single rock crusher attachment 20. The operator of the earthmoving vehicle lowers the boom carrying the twin rock crusher attachment 560 and orients the bucket portion 562 toward a pile of rocks to be crushed 46. The rocks 46 are scooped into the bucket body 570 and are directed into the first and second chutes 610 and 612 by the wedging action of the V-shaped blade 602. To facilitate the passage of the rocks 46 through the chutes 610 and 612, the bucket portion 570 could be oriented upward so that rocks 46 can make their way through the chute assisted by gravity.

The motors 702*a* and 702*b* of the jaw actuating assembly 690 are energized to thereby generate rotary motion. This rotary motion is transmitted through motor drive shafts 704*a* and 704*b* to the eccentrics 696*a* and 696*b* and through the rotary motion transmission device 694. In this way, each eccentric 696*a*, 696 is driven to rotate by both motors 702*a* and 702*b*. Advantageously, the universal joint 720 accommodates the small misalignments which may exist between the drive shafts 704*a* and 704*b*.

The rotary motion transferred to the eccentrics 696*a* and 696*b* causes the cam portions 716*a* and 716*b* to bear against the sleeve portions 792*a* and 792*b* of the stroke arm 698*a* and 698*b*, respectively. The application of the camming forces on the sleeve portions 792*a* and 792*b* causes each of them (and their respective stroke arms 698*a* and 698*b*) to travel along a generally elliptical path relative to the center axis of the elongate body 710*a*, 710*b* (as the case may be).

As the stroke arms 698*a* and 698*b* move the double toggle plate arrangements 700*a* and 700*b* are also urged to move between a position of flexion and a fully extended position and the biasing mechanisms of the crusher assemblies 622*a* and 622*b* are actuated. However, because the eccentrics 696*a* and 696*b* are arranged out-of-phase relative to each other, the double toggle plate arrangements 700*a* and 700*b* will never be in their respective fully extended positions at the same time. As a result, the movable jaw assembly of only one of the crusher assemblies 622*a* and 622*b* will be in the closed jaw setting at any given time. For example, when the movable jaw assembly 672*a* of the crusher assembly 622*a* is in the closed jaw setting, the movable jaw assembly 672*b* of the crusher assembly 622*a* will be in the open jaw setting, and vice versa. Accordingly, at any given time, only one the crusher assemblies 622*a*, 622*b* needs to draw power from the motors 702*a* and 702*b* to deliver the required crushing force. By staggering the crushing action of the crusher assemblies 622*a* and 622*b*, it makes it possible to use only two motors for the two crusher assemblies.

When either the double toggle arrangement 700*a* or the double toggle arrangement 700*b* is in the fully extended position, the upper jaw assembly 672*a* or 672*b* is urged to pivot toward the lower jaw plate 670*a* or 670*b*. As this occurs, the gap between the upper and lower jaw plates 674*a* or 674*b* and 670*a* or 670*b* at the rear of the crusher assembly 622*a* or 622*b* (as the case may be) narrows and a crushing force is applied to the rocks 46. The rocks 46 fracture into smaller rock fragments and exit the crusher assembly 622*a* or 622*b* through discharge openings 800*a* or 800*b*.

While it is generally preferred for purposes of power efficiency that a rock crusher attachment having dual crusher assemblies employ only two motors, this need not be the case in every embodiment. In an alternative embodiment, it may be possible to configure a twin rock crusher attachment with no rotary motion transmission device linking the first crusher assembly to the second crusher assembly. In such a case, each rock crusher assembly could be configured with two motors in like fashion to crusher assembly 72 and could be operated independently from the other rock crusher assembly.

Figure 20:
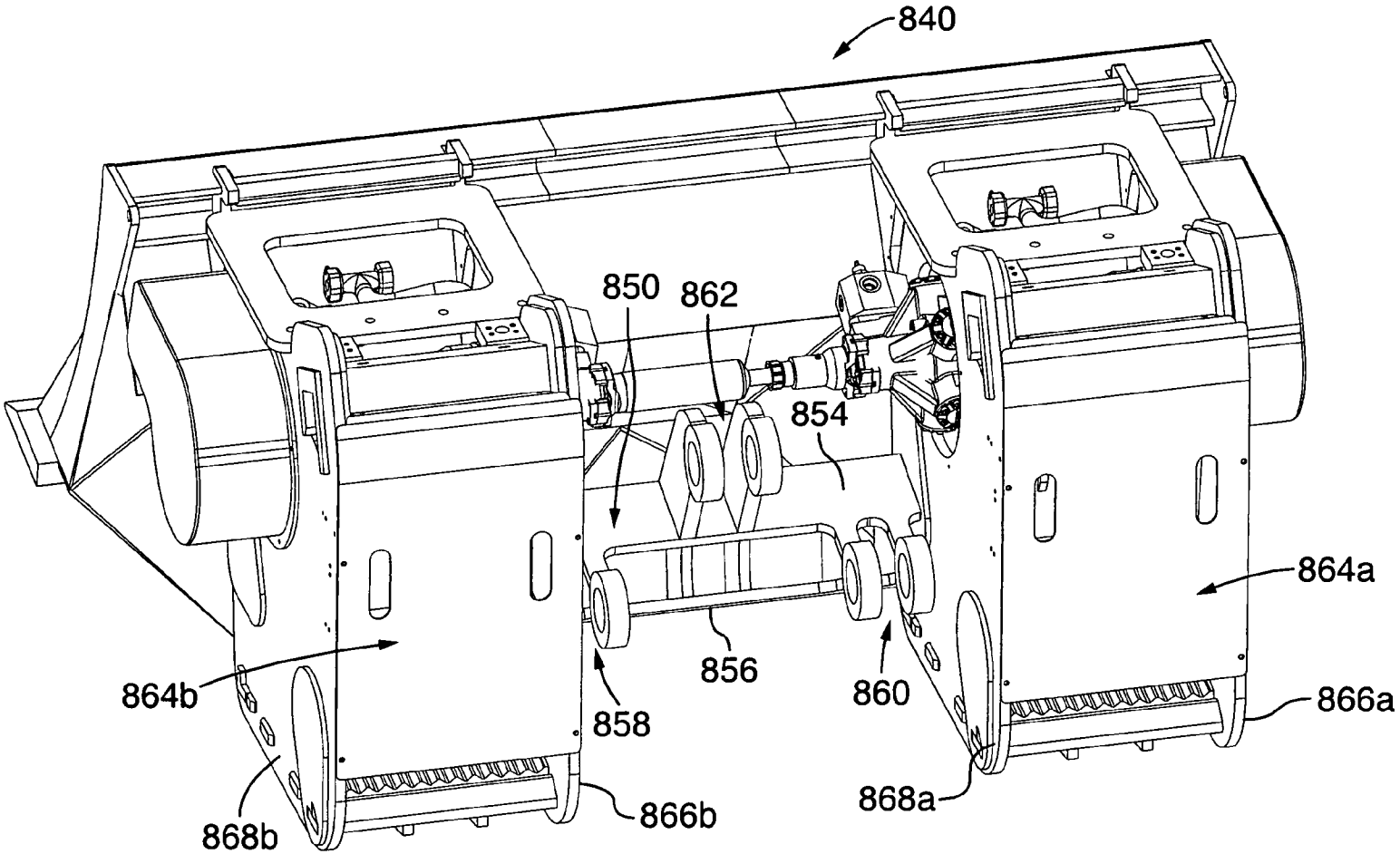
FIG. 20 is a rear perspective view of a twin rock crusher attachment according to another embodiment of the present invention.
Figure 21:
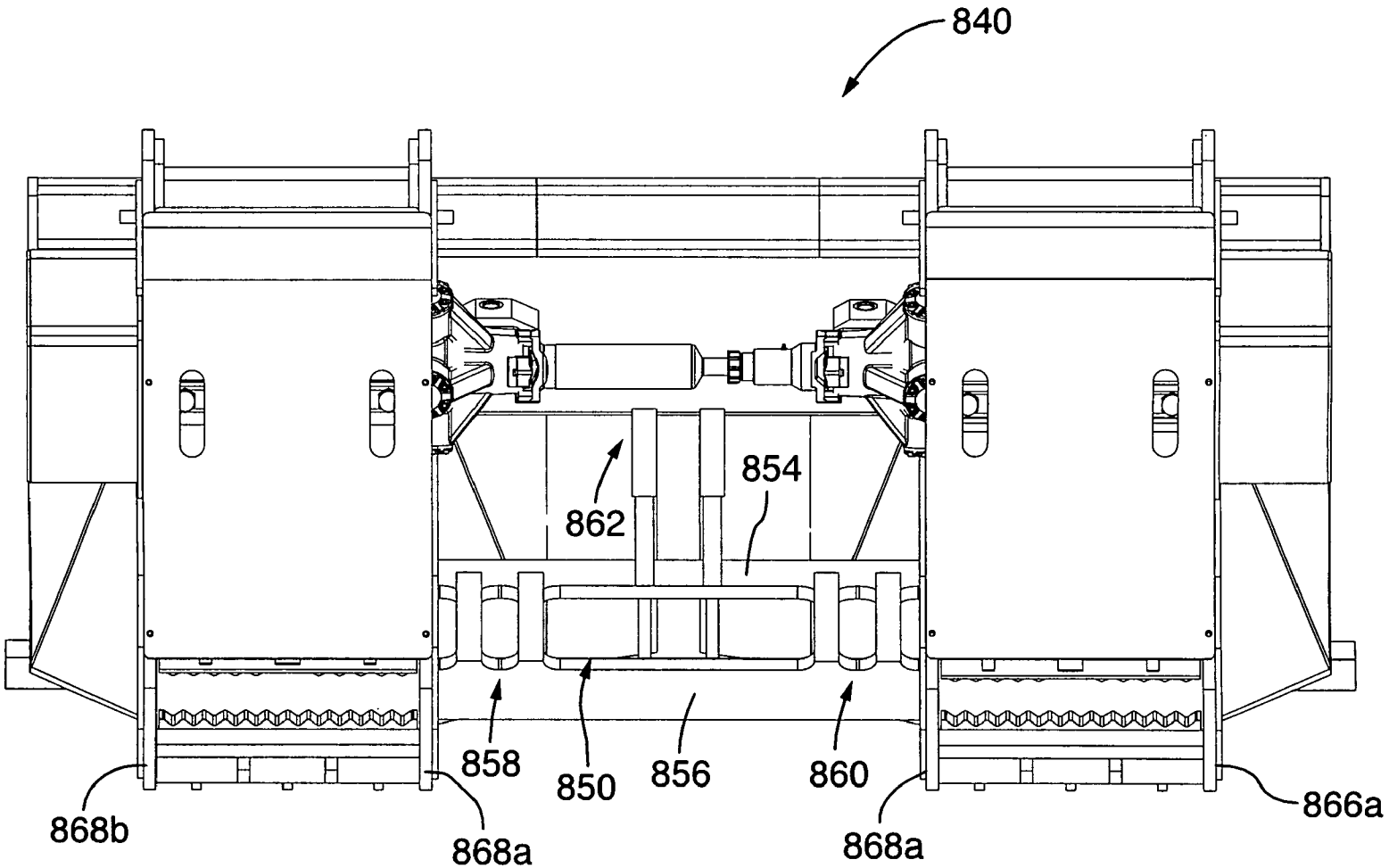
FIG. 21 is a rear end elevation view of the twin rock crusher attachment shown in FIG. 20.

Provided with the arrangement of the second plate 650 and the quick attachments 654 fittings, the twin rock crusher attachment 560 shown in FIGS. 14 to 19 is adapted for coupling to the boom of an excavator. However, it should be appreciated that different coupling arrangements could be used to connect the twin crusher attachment to other earth-moving vehicles. FIGS. 20 and 21 show an example of a coupling weldment 850 provided with a three-point, quick attachment fitting arrangement 852 which could be used to connect a twin crusher attachment 840 to a front end loader. The coupling weldment 850 includes two plates—an upper plate 854 and a lower plate 856 which are joined to each other at their rear edges by a first pair of fittings or lugs 858 and a second pair of fittings or lugs 860 spaced apart from the first pair of fittings 858. When viewed in profile, the upper and lower plates 854 and 856 diverge from each other from the rear of the weldment to the front thereof. A third pair of fittings or lugs 862 projects generally upwardly from the upper plate 854. The first, second and third pairs of fittings 858, 860 and 862 in combination with each other define the three-point quick attachment fitting arrangement 852. In this embodiment, the weldment 850 extends between and is mounted to the housings 864*a* and 864*b* (which housings are generally similar to housings 620*a* and 620*b*, with each housing 864*a*, 864*b* having first and second spaced apart side panel members 866*a* and 868*a*, and 866*b* and 868*b*, respectively). One end of each of the upper and lower plates 854 and 856 is welded to the second side panel member 868*b* of the housing 864*b* and the other end of each of the upper and lower plates 854 and 856 is welded to the first side panel member 866*a* of the housing 864*a*.

Throughout the specification, reference has been made to rocks to be crushed. However, it should be appreciated that the rock crusher attachments 20 and 560 could be used to similar advantage to crush a variety materials/objects of variable hardness, including, for example, stone, gravel, aggregate, concrete, bricks, cinder blocks, old construction materials, trap rock and the like. The rock crusher attachments 20 and 560 can be used to crush relatively soft materials having a hardness of 15,000 to 20,000 psi, but tend to also be well-suited to crush relatively hard materials having a hardness in the range of 60,000 psi to 90,000 psi. The ability to crush materials having a relatively broad range of hardness tends to make the rock crusher attachments constructed in accordance with the principles of the present invention very versatile in the field.

While the specification has described various embodiments of a portable rock crusher attachment, it should be appreciated that with appropriate modifications the principles of the present invention could be applied with equal success to the design of large, stationary or stand-alone rock crushing machinery.

Although the foregoing description and accompanying drawings relate to specific preferred embodiments of the present invention as presently contemplated by the inventor, it will be understood that various changes, modifications and adaptations, may be made without departing from the spirit of the invention.

What is claimed is:

1. A rock crusher:

a front bucket portion configured for scooping rocks to be crushed;

a rear crusher portion connected to and in communication with the rear of the bucket portion; the crusher portion including a housing and a crushing assembly accommodated within the housing; the housing including a pair of spaced apart side panels; the crushing assembly including a lower jaw fixed between the side panels of the housing and an upper movable jaw mounted opposite and spaced apart from the lower jaw; the upper movable jaw assembly including a support, an upper jaw plate attached to the underside of the support and a jaw-actuating drive assembly operable to urge the upper movable jaw assembly to move between an open jaw setting and a closed jaw vetting; the support being pivotally connected between the side panels adjacent the front of the housing; the jaw-actuating drive assembly including at least one motor carried by the support; the at least one motor being urged to move along with the upper movable jaw assembly relative to the lower jaw, when the crusher assembly is actuated.

2. The rock crusher of claim 1 wherein the jaw-actuating drive assembly further includes an eccentric operatively coupled to the at least one motor for rotation, a double toggle plate arrangement mounted between the support and a top portion of the housing, and a stroke arm disposed between and connected to each of the eccentric and the double toggle plate arrangement for transferring motion from the eccentric to the double toggle plate arrangement.

3. The rock crusher of claim 2 wherein, during actuation of the crusher assembly, the double toggle plate arrangement is on center when the stroke arm has reached the end of its stroke.

4. The rock crusher of claim 2 wherein, during actuation of the crusher assembly, the doable toggle plate arrangement is over center when the stroke arm has reached the end of its stroke.

5. The rock crusher of claim 2 wherein the double toggle plate arrangement has an upper toggle plate, a lower toggle plate, and a cylindrical shaft disposed between and in bearing engagement with the upper and lower toggle plates; the shaft being attached to the stroke arm.

6. The rock crusher of claim 5 wherein:

the upper toggle plate has an upper edge and a lower edge; the upper edge of the upper toggle plate having a first roller member fixed thereto; the lower edge of the upper toggle plate having a first arcuate plate fixed thereto; the radius of curvature of the first arcuate contact plate being configured to correspond to the radius of curvature of the shaft; and the lower toggle plate has an upper edge and a lower edge; the upper edge of the lower toggle plate having a second arcuate plate fixed thereto; the radius of curvature of the second arcuate contact plate being configured to correspond to the radius of curvature of the shaft; the lower edge of the lower toggle plate having a second a roller member fixed thereto.

7. The rock crusher of claim 6 wherein the crusher assembly is further provided with a first seat member configured to receive the first roller member and a second seat member configured to receive the second roller member; the first seat member being carried between the side panels and defining at least partially the top portion of the housing; and the second seat member being carried on the support.

8. The rock crusher of claim 7 wherein the first seat member has a slanted orientation.

9. The rock crusher of claim 8 wherein the first scat member is inclined forwardly relative to a vertical axis.

10. The rock crusher of claim 7 wherein the crusher assembly further includes an upper bearing block disposed within the first seat member; the upper bearing block being configured for bearing engagement with the first roller member.

11. The rock crusher of claim 10 wherein the crusher assembly further includes at least one shim for insertion between the first seat member and the upper bearing block for spacing the upper bearing block from the first seat member.

12. The rock crusher of claim 7 wherein:

the support has a base and a plane P that intersects the base; and the second seat member is angled relative to the plane P of the base.

13. The rock crusher of claim 7 wherein the crusher assembly further includes a lower bearing block disposed within the second seat member; the lower bearing block being configured for bearing engagement with the second roller member.

14. The rock crusher of claim 13 wherein the crusher assembly further includes a dampening pad for insertion between the second seat member and the lower bearing block.

15. The rock crusher of claim 5 wherein:

the double toggle plate arrangement is moveable between a flexed position and a fully extended position;

when the double toggle plate arrangement is in the flexed position, the upper toggle plate has a skewed orientation relative to the lower toggle plate and the movable jaw assembly is in the open jaw setting;

when the double toggle plate arrangement is in the fully-extended position, the upper toggle plate is in planar alignment with lower toggle plate and the movable jaw assembly is in the closed jaw setting.

16. The rock crusher of claim 15 wherein the jaw-actuating drive assembly further includes a biasing assembly operable to maintain the double toggle plate arrangement in the flexed position.

17. The rock crusher of claim 16 wherein biasing assembly is hydraulics-based.

18. The rock crusher of claim 17 wherein biasing assembly includes a hydraulic cylinder connected between the top portion of the housing and the carriage.

19. The rock crusher of claim 18 wherein:

the hydraulic cylinder includes a body, a piston rod mounted to extend within the body and a piston accommodated within the body and connected to the piston rod; the piston rod being moveable between a retracted position and an extended position;

the body is pivotally attached to one of the support and the top portion of the housing; and the piston rod is pivotally attached to the other of the support and the top portion of the housing.

20. The rock crusher of claim 19 wherein the piston rod is in the extended position when the double toggle plate arrangement is in its fully-extended position.

21. The rock crusher of claim 18 further the biasing assembly further includes an accumulator in fluid communication with the hydraulic cylinder, a reservoir for storing hydraulic fluid and a pump operable to charge the accumulator with hydraulic fluid from the reservoir.

22. The rock crusher of claim 5 wherein the double toggle plate arrangement further includes means for discouraging dislocation of the shaft from between the upper and lower toggle plates.

23. The rock crusher of claim 22 wherein the means for discouraging dislocation of the shaft includes at least one guard member located in front of the shaft and at least one guard member located rearward of the shaft.

24. The rock crusher of claim 2 wherein the at least one motor includes first and second motors operatively coupled to either ends of the eccentric.

25. The rock crusher of claim 1 wherein the crusher assembly has a discharge outlet defined between the upper jaw plate and the lower jaw at the rear of the housing and further includes means for adjusting the size of the discharge outlet.

26. A rock crusher attachment for an earthmoving vehicle, the rock crusher attachment comprising:

a front bucket portion configured for scooping rocks to be crushed;

a rear crusher portion connected to and in communication with the rear of the bucket portion; the crusher portion including a housing and a crushing assembly accommodated within the housing; the housing including a pair of spaced apart side panels; the crushing assembly including a lower jaw fixed between the side panels of the housing and an upper movable jaw mounted opposite and spaced apart from the lower jaw; the upper movable jaw assembly being pivotally connected between the sick panels adjacent the front of the housing; the upper movable jaw assembly including a support, an upper jaw plate attached to the underside of the support and a jaw-actuating drive assembly carried on the support; the jaw-actuating drive assembly being operable to urge the upper movable jaw assembly to move between an open jaw setting and a closed jaw setting; the jaw-actuating drive assembly including at least one motor, an eccentric operatively coupled to the at least one motor for rotation, a double toggle plate arrangement mounted between the support and a top portion of the housing, and a stroke arm disposed between and connected to each of the eccentric and the double toggle plate arrangement for transferring motion from the eccentric to the double toggle plate arrangement.

27. A rock crusher attachment for an earthmoving vehicle comprising:

a front bucket portion configured for scooping rocks to be crushed;

a first rear crusher portion connected to and in communication with the rear of the bucket portion; the first crusher portion including a first housing and a first crushing assembly accommodated within the first housing; the first housing including a pair of spaced apart side panels; the first crushing assembly including a first lower jaw fixed between the side panels of the first housing and a first upper movable jaw mounted opposite and spaced apart from the first lower jaw; the first upper movable jaw assembly including a first support and a first upper jaw plate attached to the underside of the first support; the first support being pivotally connected between the side panels of the first housing adjacent the front thereof;

a second rear crusher portion connected to and in communication with the rear of the bucket portion; the second crusher portion being spaced away from the first crusher portion; the second crusher portion including a second housing and a second crushing assembly accommodated within the second housing; the second housing including a pair of spaced apart side panels; the second crushing assembly including a second lower jaw fixed between the side panels of the second housing and a second upper movable jaw mounted opposite and spaced apart from the second lower jaw; the second movable upper jaw assembly including a second support and a second upper jaw plate attached to the underside of the second support; the second support being pivotally connected between the side panels of the second housing adjacent the front thereof; and a jaw-actuating drive assembly extending between the first and second crusher assemblies, the jaw-actuating assembly being operable to urge the first and second upper movable jaw assemblies to move between their respective open jaw settings and closed jaw settings; the jaw-actuating drive assembly including a first drive subassembly associated with the first crusher assembly, a second drive subassembly associated with the second crusher assembly and a mechanism for transmitting rotary motion between the first drive subassembly and the second drive subassembly;

the first drive subassembly includes a first motor carried by the first support; the first motor being urged to move along with the first upper movable jaw assembly relative to the first lower jaw, when the first crusher assembly is actuated;

the second drive subassembly includes a second motor carried by the second support; the second motor being urged to move along with the second upper movable jaw assembly relative to the second lower jaw, when the second crusher assembly is actuated.

28. The rock crusher attachment of claim 27 wherein:

the first drive subassembly further includes a first eccentric operatively coupled to the first motor for rotation, a first double toggle plate arrangement mounted between the first support and a top portion of the first housing, and a first stroke arm disposed between and connected to each of the first eccentric and the first double toggle plate arrangement for transferring motion from the first eccentric to the first double toggle plate arrangement;

the second drive subassembly further includes a second eccentric operatively coupled to the second motor for rotation, a second double toggle plate arrangement mounted between the second support and a top portion of the second housing, and a second stroke arm disposed between and connected to each of the second eccentric and the second double toggle plate arrangement for transferring motion from the second eccentric to the second double toggle plate arrangement;

the mechanism for transmitting rotary motion between the first drive subassembly and the second drive subassembly is a universal joint assembly, the universal joint assembly having a first portion operatively coupled to the first eccentric and a second portion operatively coupled to the second eccentric.

29. The rock crusher attachment of claim 28 wherein the first eccentric is rotationally out-of-phase relative to the second eccentric.

30. The rock crusher attachment of claim 28 wherein the first eccentric is rotationally out-of-phase relative to the second eccentric by an angle of 180 degrees.

31. The rock crusher attachment of claim 27 wherein the mechanism for transmitting rotary motion between the first drive subassembly and the second drive subassembly includes a universal joint assembly.

32. The rock crusher attachment of claim 27 wherein the front bucket portion includes a centrally disposed V-shaped blade portion for directing rocks to be crushed to the first and second rear crusher portions.

33. A rock crusher attachment for an earthmoving vehicle comprising:

a front bucket portion configured for scooping rocks to be crushed;

a first rear crusher portion connected to and in communication with the rear of the bucket portion; the first crusher portion including a first housing and a first crushing assembly accommodated within the first housing; the first housing including a pair of spaced apart side panels; the first crushing assembly including a first lower jaw fixed between the side panels of the first housing and a first upper movable jaw mounted opposite and spaced apart from the first lower jaw; the first upper movable jaw assembly including a first support, a first upper jaw plate attached to the underside of the first support and a first jaw-actuating drive assembly operable to urge the upper movable jaw assembly to move between an open jaw setting and a closed jaw setting; the first support being pivotally connected between the side panels of the first housing adjacent the front thereof; the first jaw-actuating drive assembly including at least one motor carried by the first support; the at least one motor of the first jaw-actuating assembly being urged to move along with the first upper movable jaw assembly relative to the first lower jaw, when the first crusher assembly is actuated;

a second rear crusher portion connected to and in communication with the rear of the bucket portion; the second crusher portion being spaced away from the first crusher portion; the second crusher portion including a second housing and a second crushing assembly accommodated within the second housing; the second housing including a pair of spaced apart side panels; the second crushing assembly including a second lower jaw fixed between the side panels of the second housing and a second upper movable jaw mounted opposite and spaced apart from the second lower jaw; the second upper movable jaw assembly including a second support, a second upper jaw plate attached to the underside of the second support and a second jaw-actuating drive assembly operable to urge the upper movable jaw assembly to move between an open jaw setting and a closed jaw setting; the second support being pivotally connected between the side panels of the second housing adjacent the front thereof; the second jaw-actuating drive assembly including at least one motor carried by the second support; the at least one motor of the second jaw-actuating assembly being urged to move along with the second upper movable jaw assembly relative to the second lower jaw, when the second crusher assembly is actuated.

* * * * *